US011485552B2

(12) United States Patent
Armstrong et al.

(10) Patent No.: US 11,485,552 B2
(45) Date of Patent: Nov. 1, 2022

(54) DISPENSER PACKAGE WITH FLIP-UP LID AND METHOD OF MAKING THE SAME

(71) Applicant: McCormick & Company, Incorporated, Hunt Valley, MD (US)

(72) Inventors: Mark Armstrong, Gwynedd Wales (GB); Janet Anne Oliver, Maidenhead (GB); Olivier Rattin, Althen-des-Paluds (FR)

(73) Assignee: MCCORMICK & COMPANY, INCORPORATED, Hunt Valley, MD (US)

( * ) Notice: Subject to any disclaimer, the term of this patent is extended or adjusted under 35 U.S.C. 154(b) by 106 days.

(21) Appl. No.: 16/980,975

(22) PCT Filed: Mar. 14, 2019

(86) PCT No.: PCT/US2019/022283
§ 371 (c)(1),
(2) Date: Sep. 15, 2020

(87) PCT Pub. No.: WO2019/178363
PCT Pub. Date: Sep. 19, 2019

(65) Prior Publication Data

US 2020/0407128 A1 Dec. 31, 2020

Related U.S. Application Data

(60) Provisional application No. 62/644,123, filed on Mar. 16, 2018.

(51) Int. Cl.
*B65D 47/08* (2006.01)
*B65D 8/00* (2006.01)
(Continued)

(52) U.S. Cl.
CPC ..... *B65D 47/0838* (2013.01); *B65D 15/16* (2013.01); *B65D 51/248* (2013.01);
(Continued)

(58) Field of Classification Search
CPC .. B65D 47/0838; B65D 15/16; B65D 51/248; B65D 83/06; B65D 2251/01; B65D 2251/20; B65D 21/0222; B65D 21/023
See application file for complete search history.

(56) References Cited

U.S. PATENT DOCUMENTS 4,291,818 A 9/1981 Nozawa et al.
6,299,033 B1 * 10/2001 VerWeyst ..... B65D 83/06 222/546
(Continued)

FOREIGN PATENT DOCUMENTS

WO 2008/030906 3/2008
WO 2012044722 4/2012

OTHER PUBLICATIONS

Official Communication issued in International Bureau of WIPO Patent Application No. PCT/US2019/22283, dated Jul. 30, 2019.
(Continued)

*Primary Examiner* — Shawn M Braden
(74) *Attorney, Agent, or Firm* — Greenblum & Bernstein, P.L.C.

(57) ABSTRACT

The invention provides for a dispenser package comprising a generally cylindrical container body and a cap removably mounted to the container body. The cap comprises a generally cylindrical cap body securable to an upper end of the container body. The cap body comprises a generally circular projecting portion having an outer circumferential surface and an upper surface that includes plural dispensing openings. A generally circular flip-up lid is connected to the cap
(Continued)

body by a living hinge and being movable between a covering position and an open position.

20 Claims, 44 Drawing Sheets

(51) Int. Cl.
*B65D 51/24* (2006.01)
*B65D 83/06* (2006.01)

(52) U.S. Cl.
CPC ..... *B65D 83/06* (2013.01); *B65D 2251/01* (2013.01); *B65D 2251/20* (2013.01)

(56) References Cited

U.S. PATENT DOCUMENTS 6,742,666 B1 6/2004 Bried et al.
7,032,756 B2 * 4/2006 Wylie ..... B65D 1/18 206/508
2007/0228079 A1 * 10/2007 Vogel ..... B65D 47/0838 222/548
2013/0233897 A1 9/2013 Mack
2017/0129658 A1 5/2017 Moody

OTHER PUBLICATIONS

Official Communication issued in International Bureau of WIPO Patent Application No. PCT/US2019/22283, dated Sep. 22, 2020.
Partial Supplementary European Search Report for EP19767123.3 dated Nov. 19, 2021.
Extended European Search Report for corresponding family member EP 19767123.3 dated Feb. 23, 2022.
Supplementary European Search Report for corresponding family member EP 19767123.3 dated Mar. 15, 2022.

* cited by examiner

DISPENSER PACKAGE WITH FLIP-UP LID AND METHOD OF MAKING THE SAME

CROSS-REFERENCE TO RELATED APPLICATIONS

The instant application claims priority under 35 U.S.C. § 119(e) of U.S. provisional Patent Application No. 62/644,123 filed on Mar. 16, 2018. The disclosure of which is expressly incorporated by reference herein in its entirety.

BACKGROUND OF THE INVENTION

1. Field of the Invention

This invention relates generally to package dispensers or dispenser packaging and especially for dry food or granulated product such as, e.g., spice, salt or pepper containers, and well as a method of making and using the same.

2. Discussion of Background Information

Known packaging dispensers are available in small size but are generally not easily closeable and openable. Nor are they generally made of materials that are mostly, nearly mostly, or fully recyclable such as recyclable glass or recyclable synthetic resin.

Moreover, existing or known dry food packaging dispensers lack one or more features utilized in the packaging dispenser disclosed herein.

SUMMARY OF THE INVENTION

Non-limiting embodiments of the invention provide for a dispenser package comprising a generally cylindrical container body and a cap removably mounted to the container body. The cap may comprise a generally cylindrical cap body securable to an upper end of the container body. The cap body may comprise a generally circular projecting portion having an outer circumferential surface and an upper surface that includes plural dispensing openings. A generally circular flip-up lid is connected to the cap body by a living hinge and is movable between a covering position and an open position. The flip-up lid may comprise an inner circumferential surface that is engagable with the outer circumferential surface of the projecting portion. The engagement between the inner circumferential surface and the outer circumferential surface is at least one of a snap-engagement which produces an audible sound when the flip-up lid is opened and/or closed and a sealing engagement which prevents an exchange of air between an interior of the dispenser package and an atmosphere outside the dispenser package.

In embodiments, the dispenser package has an outer diameter of between 1 and 2 inches and an overall axial length of between 3.5 and 4.5 inches.

In embodiments, the outer diameter is between 1.5 and 1.75 inches.

In embodiments, the overall axial length is between 3.75 and 4.25 inches.

In embodiments, the container body is one of substantially transparent and substantially translucent.

In embodiments, the container body is made of one of a recyclable material and glass.

In embodiments, the cap is made of one of a recyclable material and synthetic resin.

In embodiments, the living hinge is configured to retain the flip-up lid in a predetermined angular open position.

In embodiments, the predetermined angular open position is an angle between 20 degrees and 45 degrees relative to a vertical center axis of the container body.

In embodiments, the predetermined angular open position is an angle of about 30 degrees relative to a vertical center axis of the container body.

In embodiments, a diameter of the outer circumferential surface is about 1.25 inches.

In embodiments, the outer circumferential surface is outwardly curved.

In embodiments, the outer circumferential surface may comprise an outwardly curved surface and a circumferential indentation.

In embodiments, the inner circumferential surface may comprise a projection.

In embodiments, the projection is disposed on a lower end of the inner circumferential surface when the flip-up lid is in a closed position and the container body is in an upright position.

In embodiments, the dispenser package contains a spice.

In embodiments, the spice is food seasoning, granules, plant seeds or plant leaves such as oregano.

In embodiments, the flip-up lid may comprise a projecting portion disposed on a front side of the flip-up lid and wherein the cap body may comprise a recessed portion disposed on a front side of the cap body.

In embodiments, the projecting portion disposed on the front side of the flip-up lid is outwardly curved and wherein the recessed portion disposed on the front side of the cap body is inwardly curved in a complementary manner.

In embodiments, the cap has an axial length of between 0.75 and 1 inch.

In embodiments, the flip-up lid may comprise a main portion and an outer portion that is at least a visually recognizable over-molded outer portion and different in color or texture than the main portion.

In embodiments, the plural dispensing openings comprise three pie-shaped pouring openings.

In embodiments, the plural dispensing openings comprise five semi-pie-shaped sifting openings.

In embodiments, the plural dispensing openings comprise five sieve openings;

The invention also provides for a spice dispenser package container body comprising a generally cylindrical transparent sidewall, a closed bottom having an external notch and semi-rounded projections, an open upper end extending to a circular rim, a removable seal closing off the open upper end and an external thread arranged on the open upper end.

The invention also provides for a dispenser package cap configured to be mounted to a spice container. The cap may comprise a generally cylindrical cap body securable to an upper end of the container body. The cap body may comprise a generally circular projecting portion having an outer circumferential surface and an upper surface that includes plural dispensing openings. A generally circular flip-up lid is connected to the cap body by a living hinge and being movable between a covering position and an open position. The flip-up lid may comprise an inner circumferential surface that is engagable with the outer circumferential surface of the projecting portion. The engagement between the inner circumferential surface and the outer circumferential surface is at least one of a snap-engagement which produces an audible sound when the flip-up lid is opened and closed and a sealing engagement which prevents an exchange of air between an interior of the dispenser package and an atmosphere outside the dispenser package.

The invention also provides for a fully or nearly-fully recyclable spice or seasoning dispenser package comprising a generally cylindrical transparent container body made of mostly recycled glass and having an open upper end of sufficient size to permit passage there-through of a tea spoon. A recyclable synthetic resin cap is removably mounted to the container body and may comprise a generally cylindrical cap body securable to an upper end of the container body. The cap body may comprise a generally circular projecting portion having an outer circumferential surface and an upper surface that includes plural dispensing openings. A flip-up lid is connected to the cap body by a living hinge and being movable between a covering position and an open position. A finger engagable portion at least partially surrounds an upper portion of the flip-up lid, said finger engagable portion being made of a softer, less-rigid and/or more flexible material than a main portion of the flip-up lid. The flip-up lid may comprise an inner circumferential surface that is engagable with the outer circumferential surface of the projecting portion. The living hinge is configured to retain the flip-up lid in a predetermined angular open position. The engagement between the inner circumferential surface and the outer circumferential surface is at least one of a snap-engagement which produces an audible sound when the flip-up lid is opened and/or closed and a sealing engagement which prevents an exchange of air between an interior of the dispenser package and an atmosphere outside the dispenser package.

In embodiments, the flip-up lid may comprise an upper planar outer surface configured to receive product identification indicia.

In embodiments, an inside diameter of the open upper end is about 1.25 inches.

In embodiments, the invention provides for a method of making the dispenser package of anyone of types described above, wherein the method may comprise placing a food product inside the container body and mounting the cap to the container body.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 1:
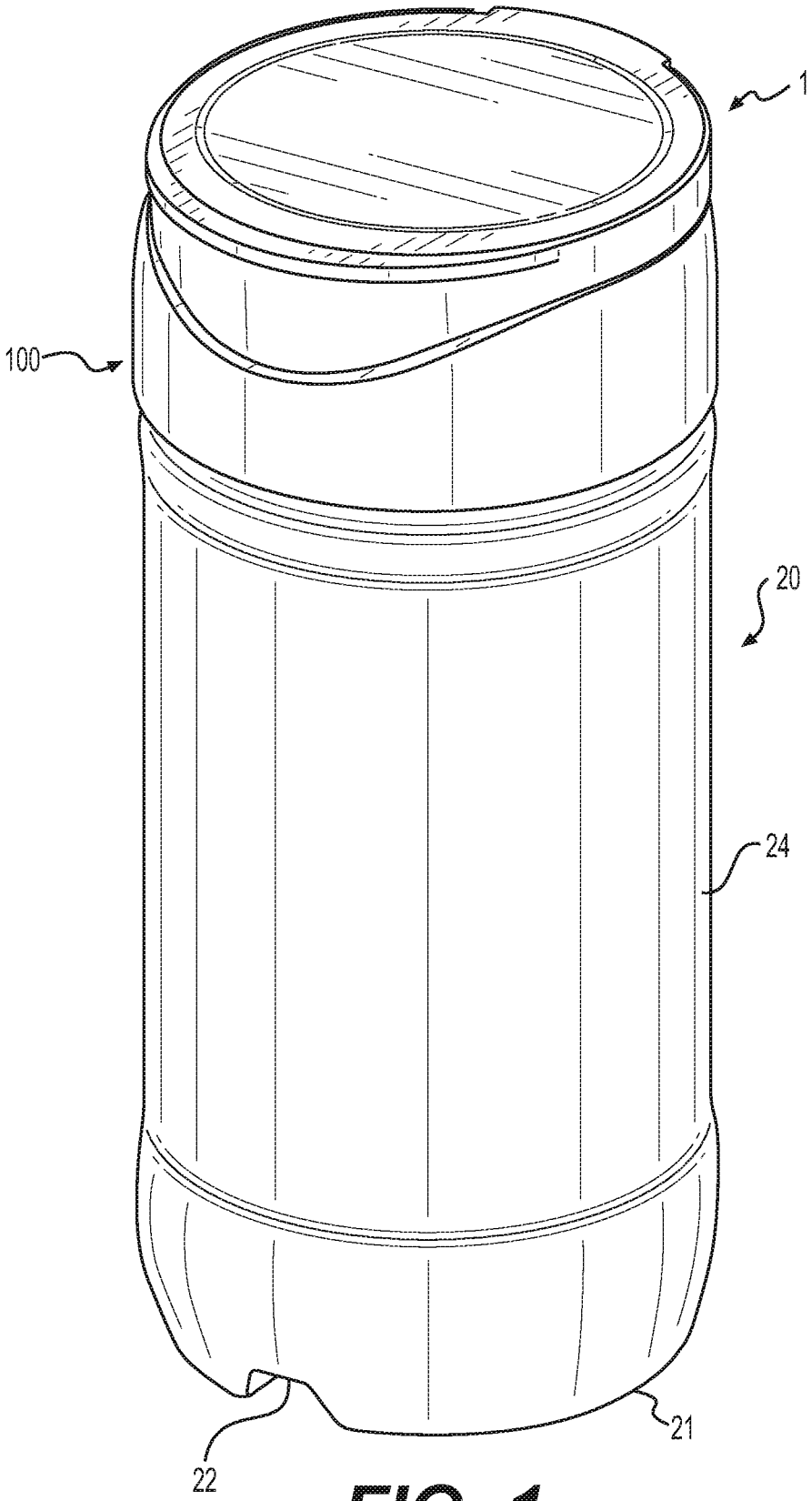
FIG. 1 shows a perspective view of a dispenser package in accordance with the invention.
Figure 2:
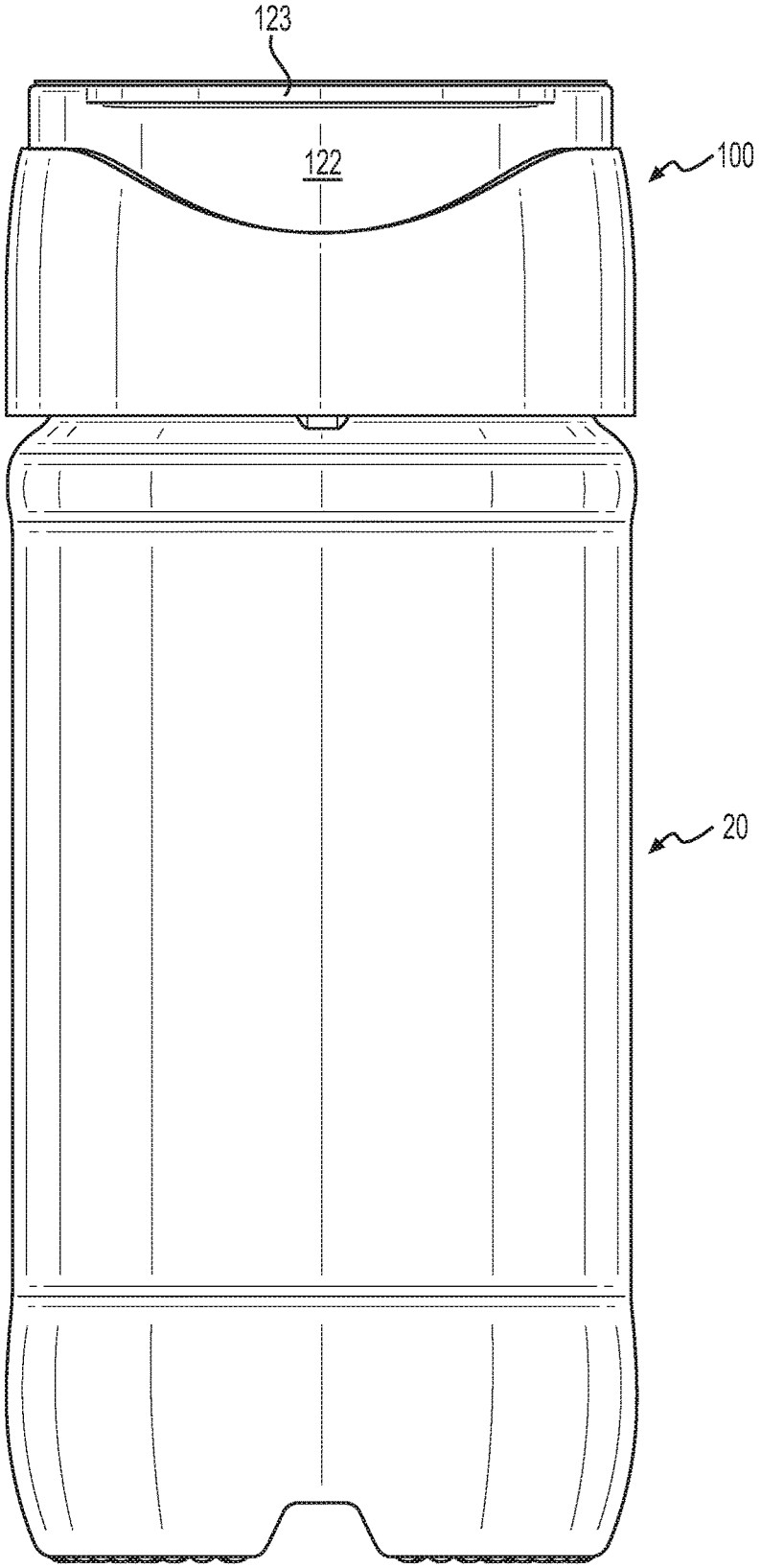
FIG. 2 shows a front view of a dispenser package of FIG. 1.
Figure 3:
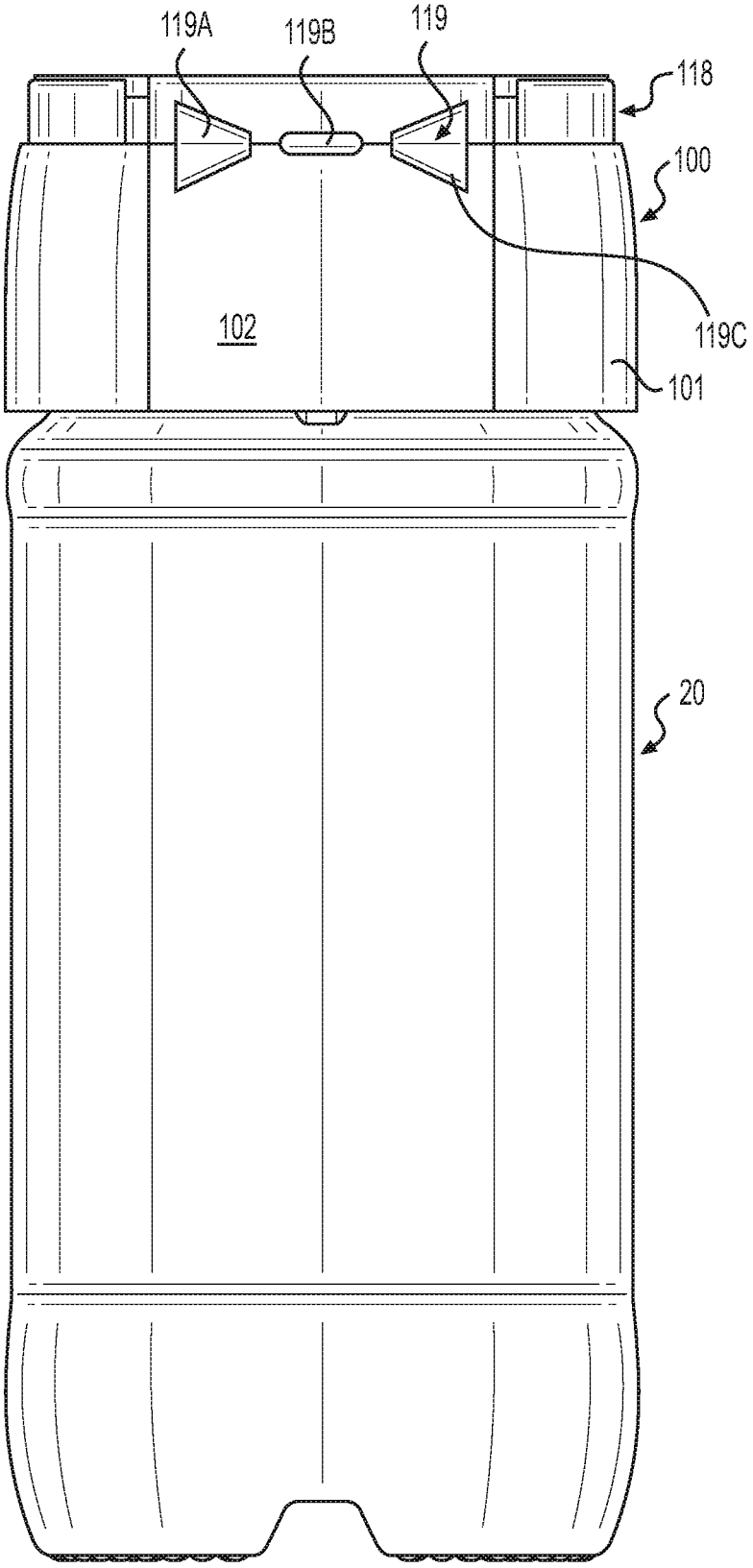
FIG. 3 shows a back view of a dispenser package of FIG. 1.
Figure 4:
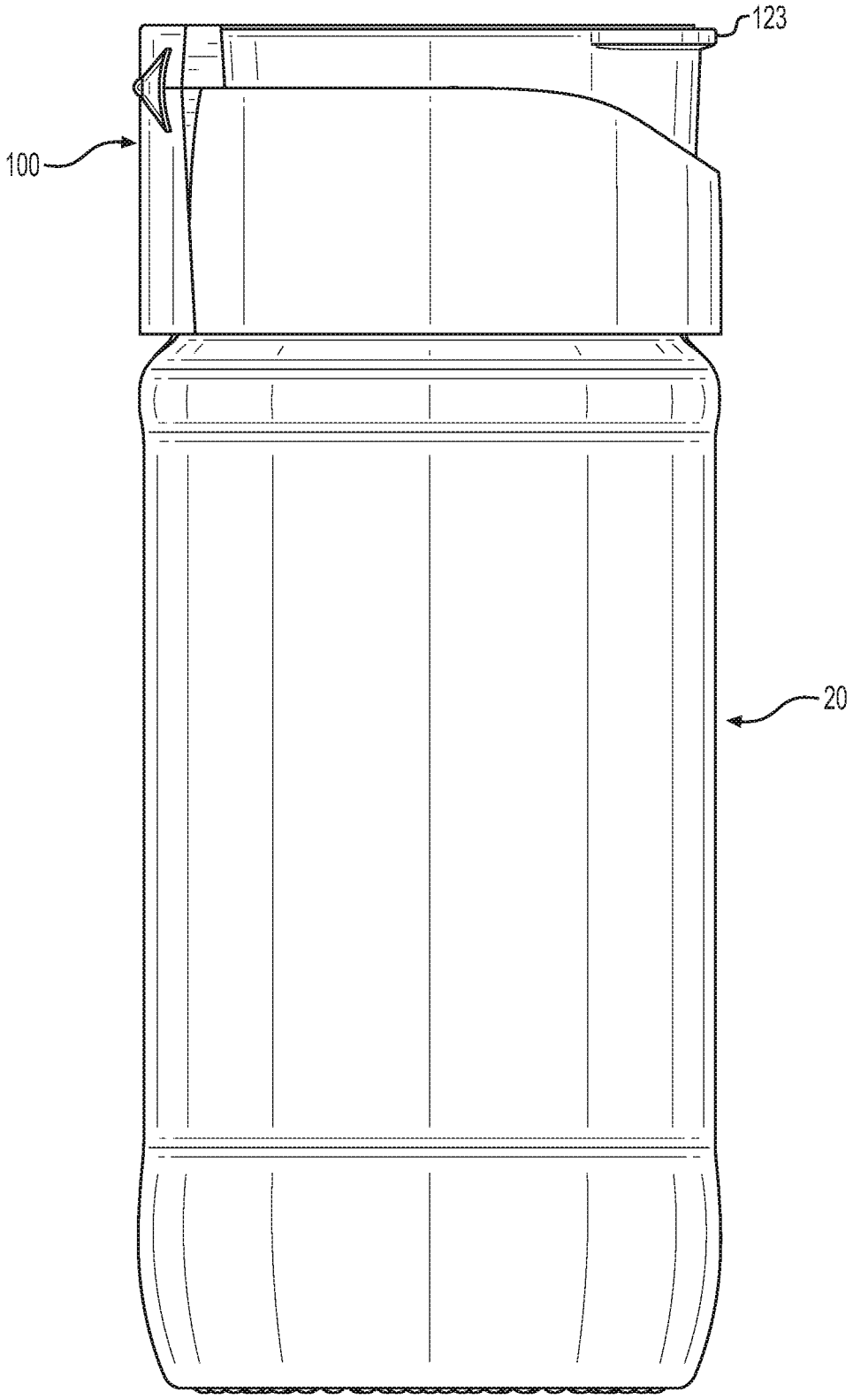
FIG. 4 shows a left view of a dispenser package of FIG. 1.
Figure 5:
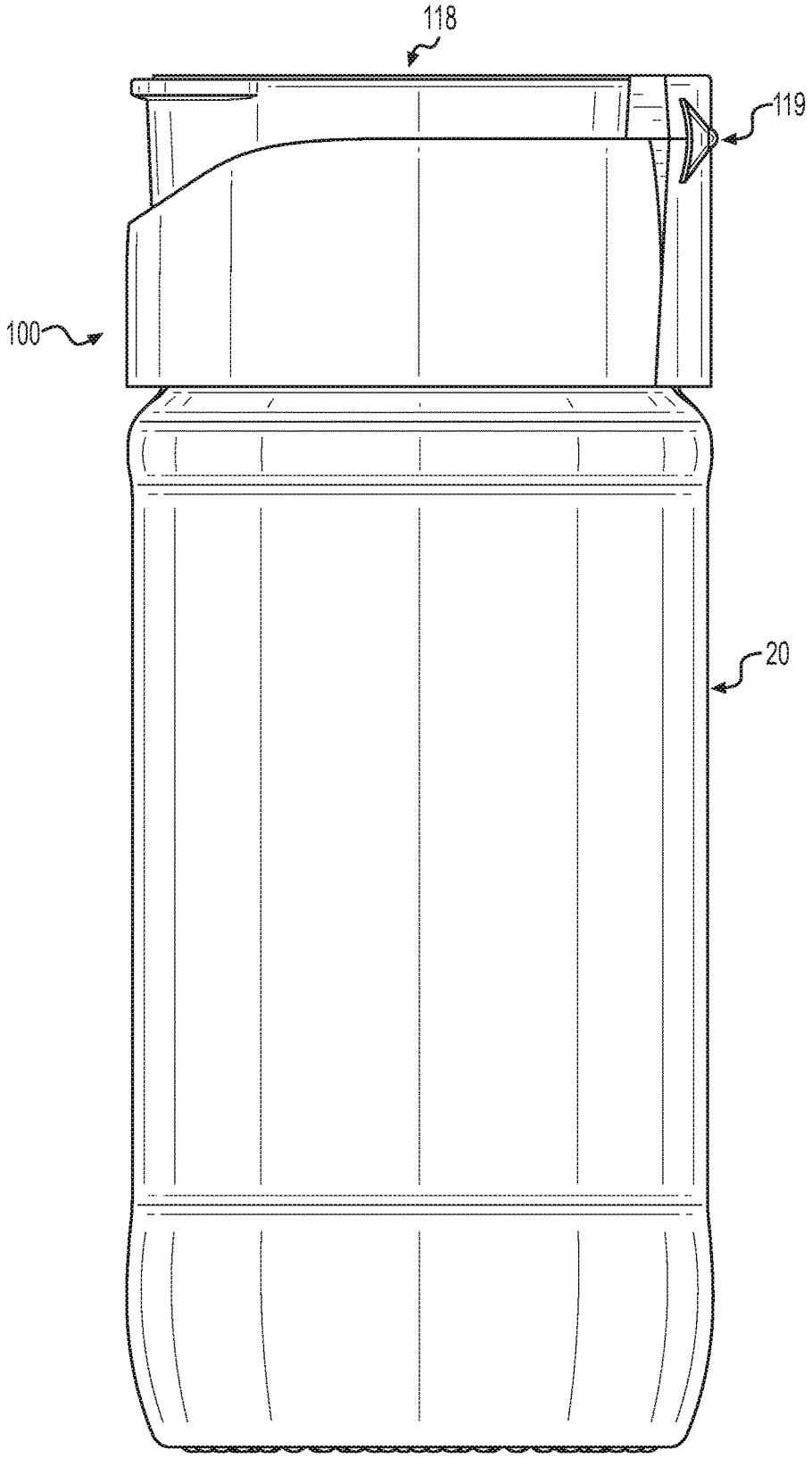
FIG. 5 shows a right view of a dispenser package of FIG. 1.
Figure 6:
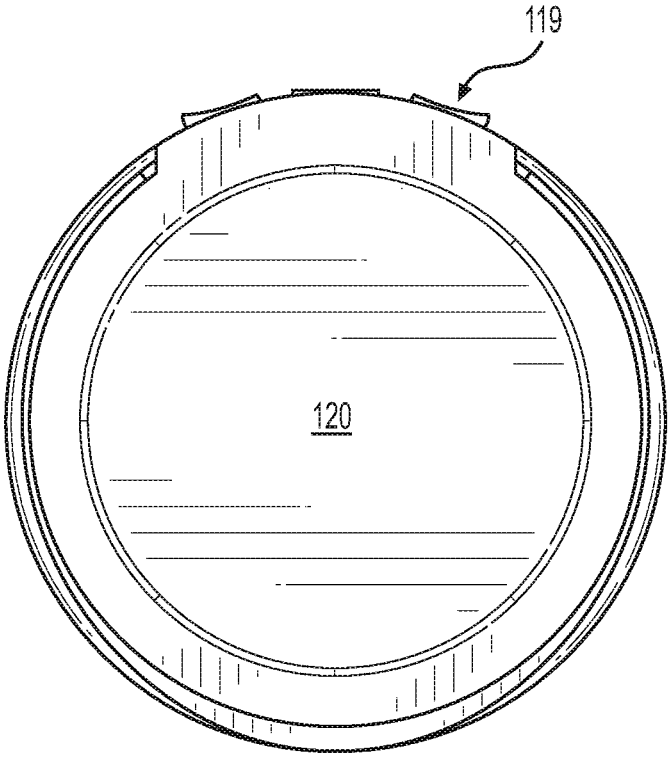
FIG. 6 shows a top view of a dispenser package of FIG. 1.

The following detailed description illustrates by way of example, not by way of limitation, the principles of the disclosure. This description will clearly enable one skilled in the art to make and use the disclosure, and describes several embodiments, adaptations, variations, alternatives and uses of the disclosure, including what is presently believed to be the best mode of carrying out the disclosure. It should be understood that the drawings are diagrammatic and schematic representations of exemplary embodiments of the disclosure and are not limiting of the present disclosure nor are they necessarily drawn to scale.

The novel features which are characteristic of the disclosure, both as to structure and method of operation thereof, together with further aims and advantages thereof, will be understood from the following description, considered in connection with the accompanying drawings, in which an embodiment of the disclosure is illustrated by way of example. It is to be expressly understood, however, that the drawings are for the purpose of illustration and description only, and they are not intended as a definition of the limits of the disclosure.

In the following description, the various embodiments of the present disclosure will be described with respect to the enclosed drawings. As required, detailed embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a material" would also mean that mixtures of one or more materials can be present unless specifically excluded. As used herein, the indefinite article "a" indicates one as well as more than one and does not necessarily limit its referent noun to the singular.

Except where otherwise indicated, all numbers expressing quantities used in the specification and claims are to be understood as being modified in all examples by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 23.7, 34, 46.1 or any other whole number or decimal value or range within the range.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for example a composition comprising a compound A may include other compounds besides A. However, the term "comprising" also covers the more restrictive meanings of "consisting essentially of" and "consisting of", so that for example "a composition comprising a compound A" may also (essentially) consist of the compound A. Similarly, a device or element comprising feature A may include other features besides A.

The various embodiments disclosed herein can be used separately and in various combinations unless specifically stated to the contrary.

The present invention is further described in the detailed description which follows, in reference to exemplary embodiments.

FIGS. 1-14 show a first non-limiting embodiment of a dispenser package 1. The dispenser package 1 includes two main components which include a container or container body 20, a cap 100, and also an optional removable seal 10 (see FIGS. 44 and 45). As shown in FIG. 1, the cap 100 is arranged on an upper end of the container 20 which has a sidewall 24 and a bottom 21 that can be notched 22.

Figure 44:
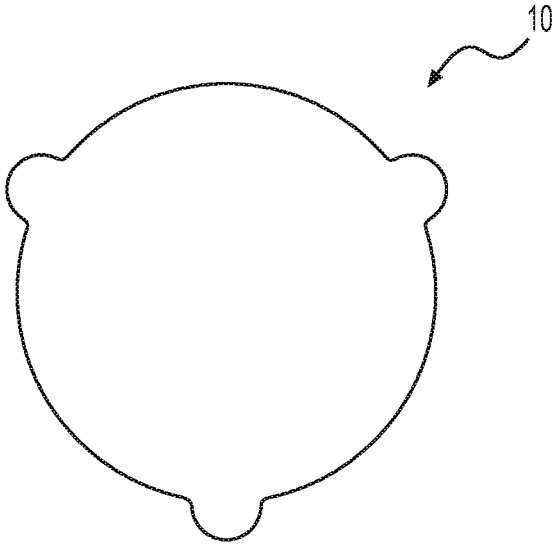
FIG. 44 shows a top view of an exemplary seal member that can be removably secured to a rim of the container body.
Figure 45:
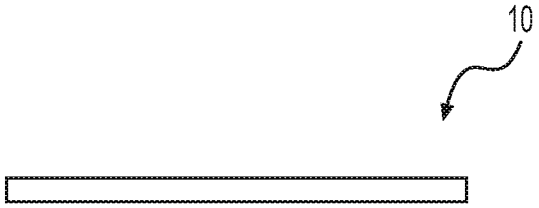
FIG. 45 shows a side view of the seal member of FIG. 44.

The removable seal 10, as exemplified in FIGS. 44 and 45 can be used with any of the herein noted embodiments, and is a sheet-like member having a layer that can be readily adhered to a rim 27 of the container 20 so as to function as a tamper-proof or tamper-evident element. In accordance with non-limiting aspects of the invention, a consumer will typically remove the cap 100 from the container 20 to access the container rim 27, which will have the seal 10 adhered thereto, i.e., a peripheral area of a lower surface of the seal 10 will be releasably adhered to the rim 27. The one or more projecting tabs of the seal 10 allow the user to grip the seal 10 and peel the same off of the rim 27. Once the seal 10 is removed or peeled-off, the consumer can re-install the cap 100 and use the dispenser package 1 as intended. However, as the seal 10 can be attached to the rim 17 initially, the consumer can be assured that the contents have not been previously tampered with, have not been added to, and/or have not been reduced prior to purchase or use.

Figure 7:
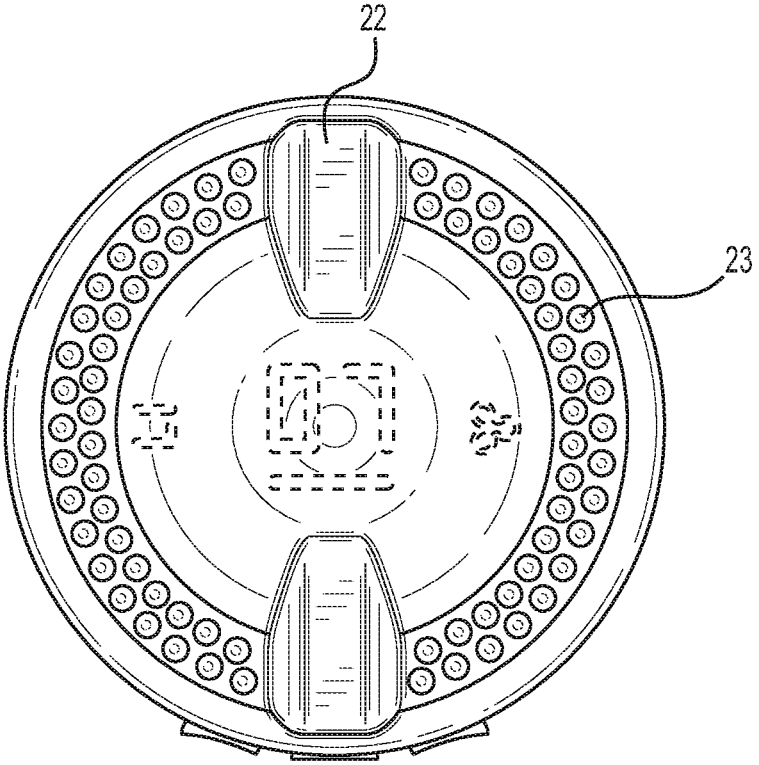
FIG. 7 shows a bottom view of a dispenser package of FIG. 1.
Figure 8:
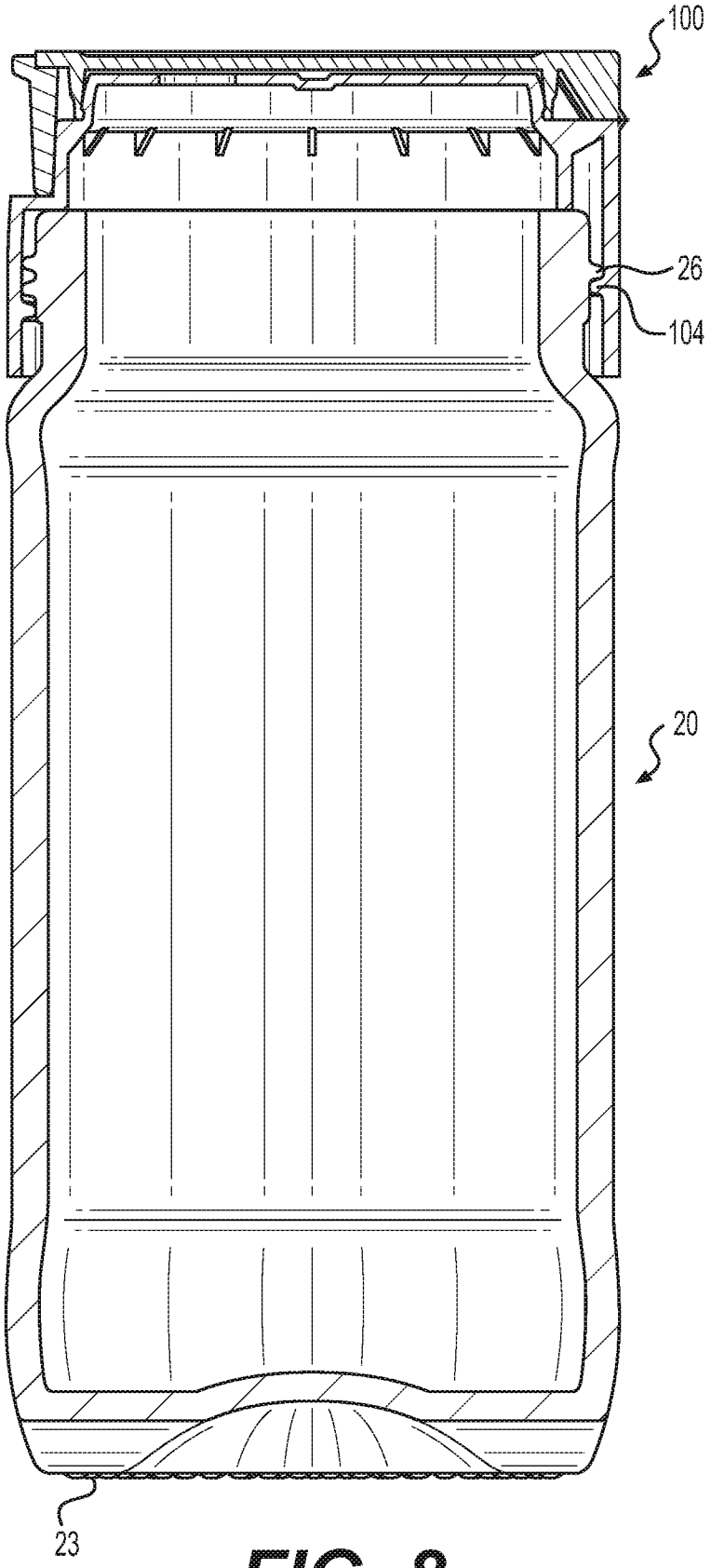
FIG. 8 shows a cross-section view of a dispenser package of FIG. 5.
Figure 9:
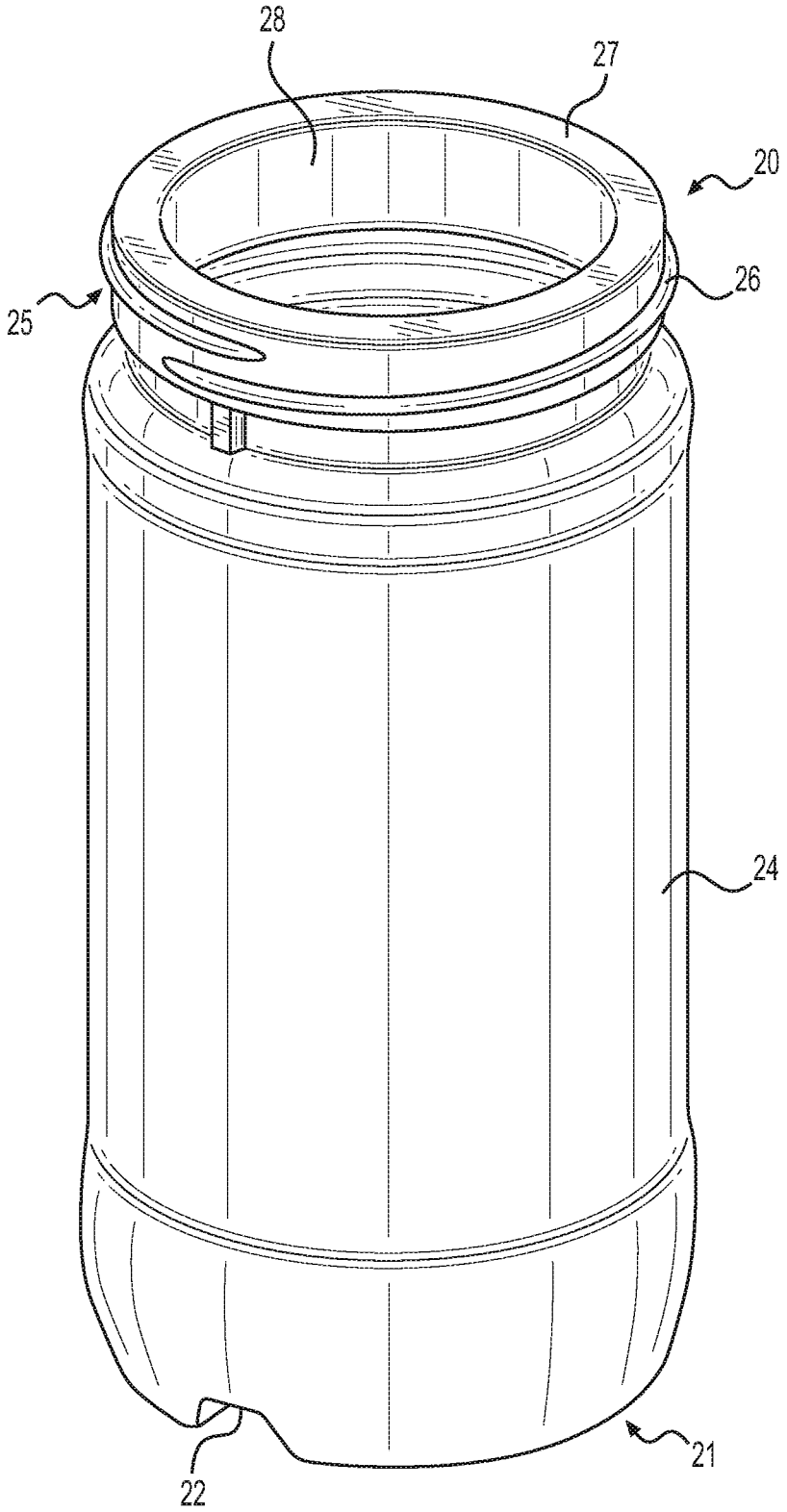
FIG. 9 shows a perspective view of the container body used in the dispenser package of FIG. 1.
Figure 10:
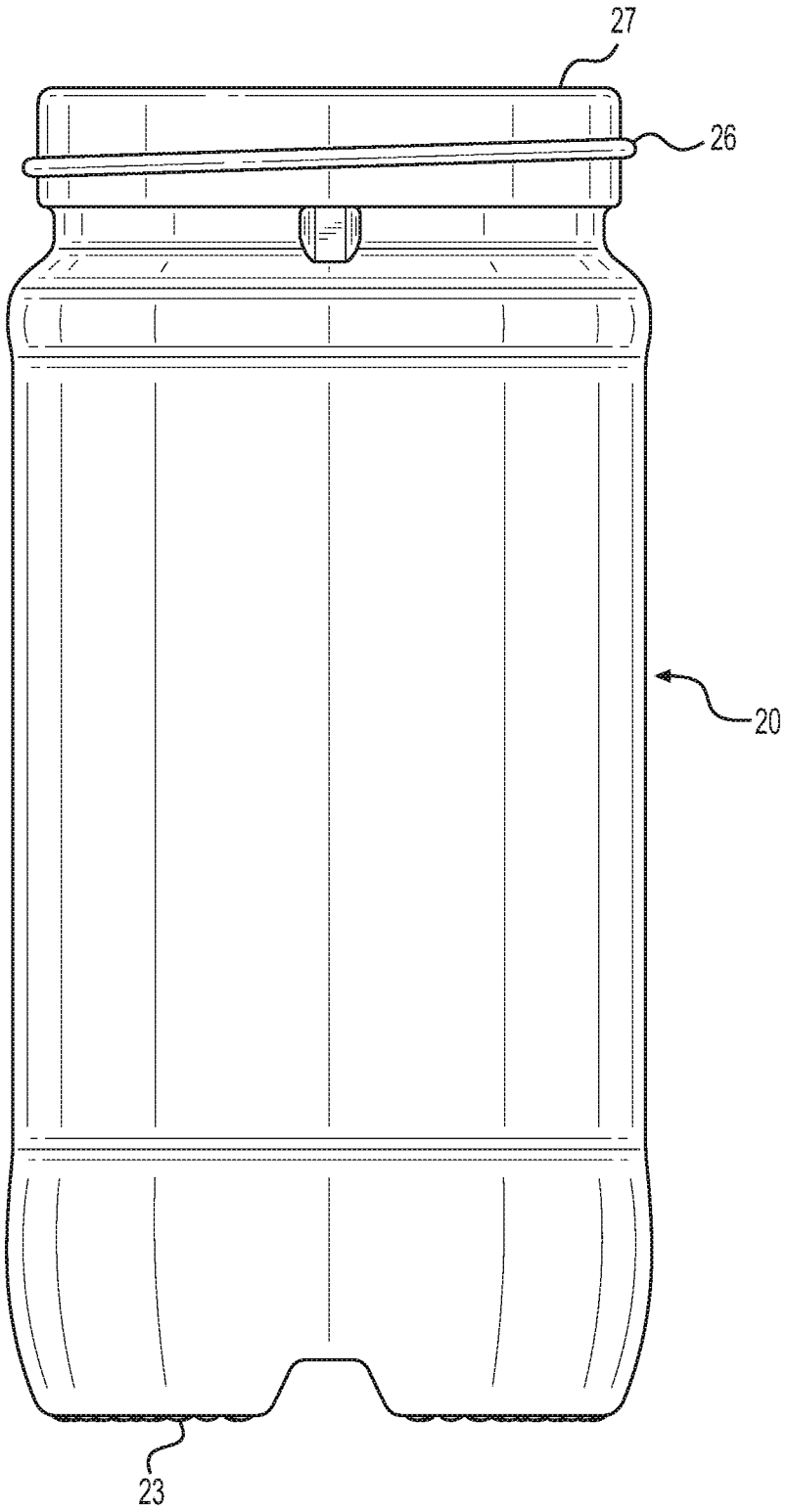
FIG. 10 shows a front view of a dispenser package of FIG. 9.
Figure 11:
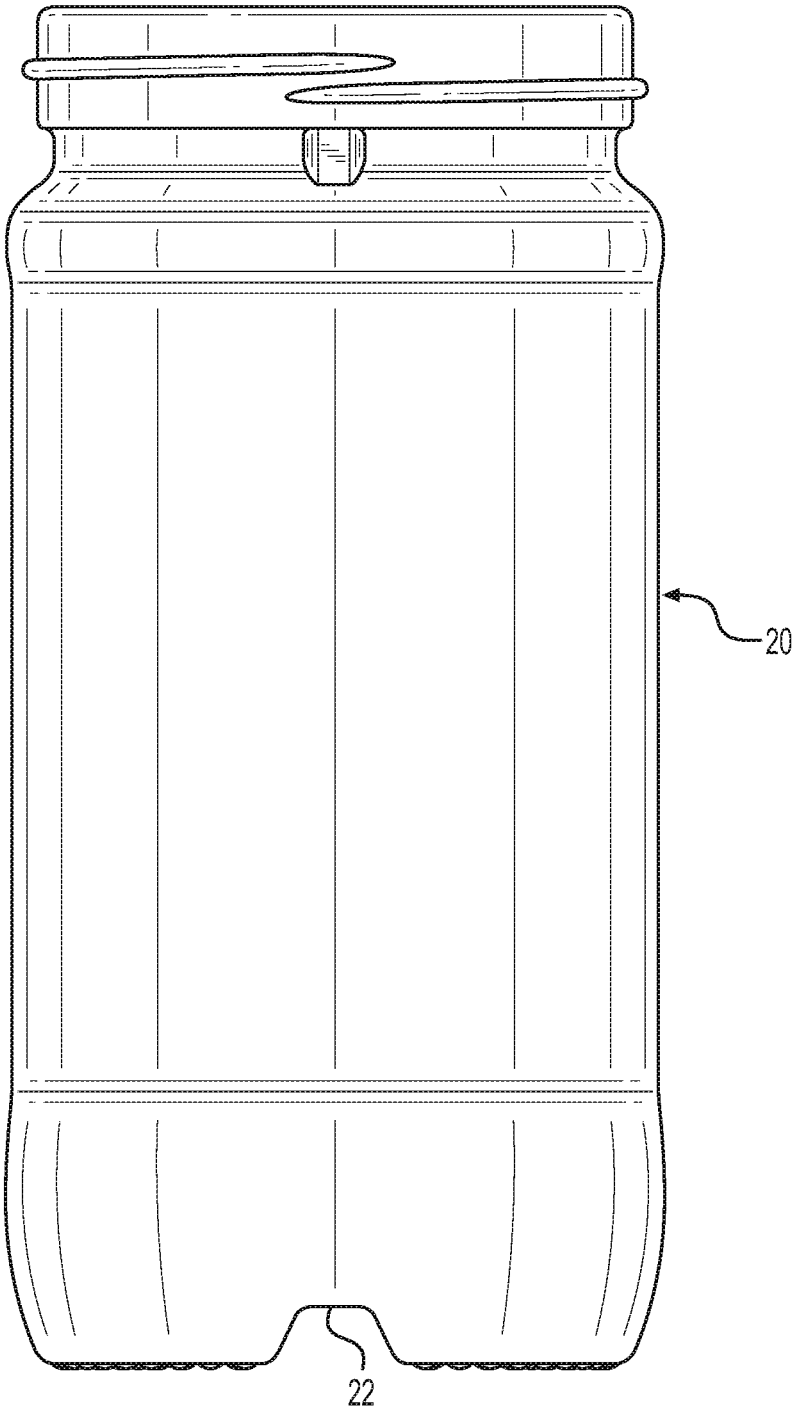
FIG. 11 shows a back view of a dispenser package of FIG. 9.
Figure 12:
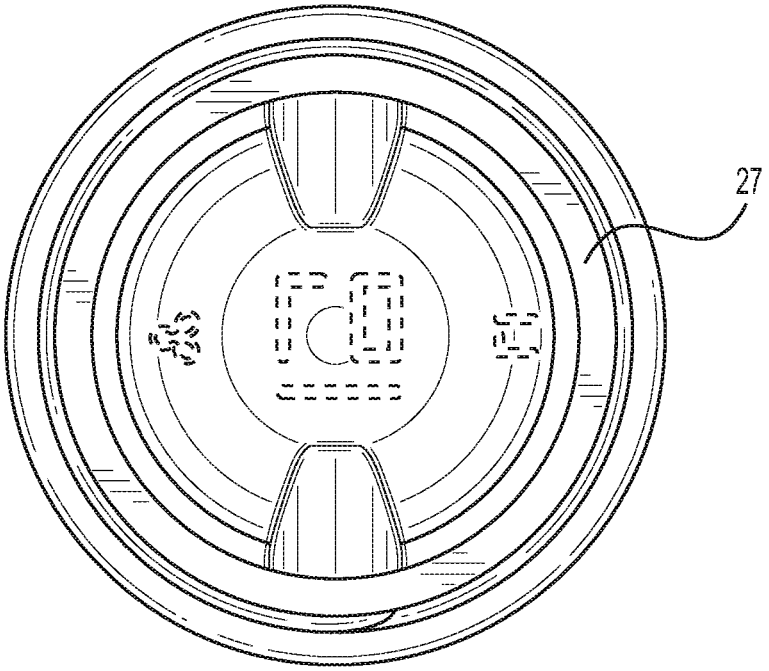
FIG. 12 shows a top view of a dispenser package of FIG. 9.
Figure 13:
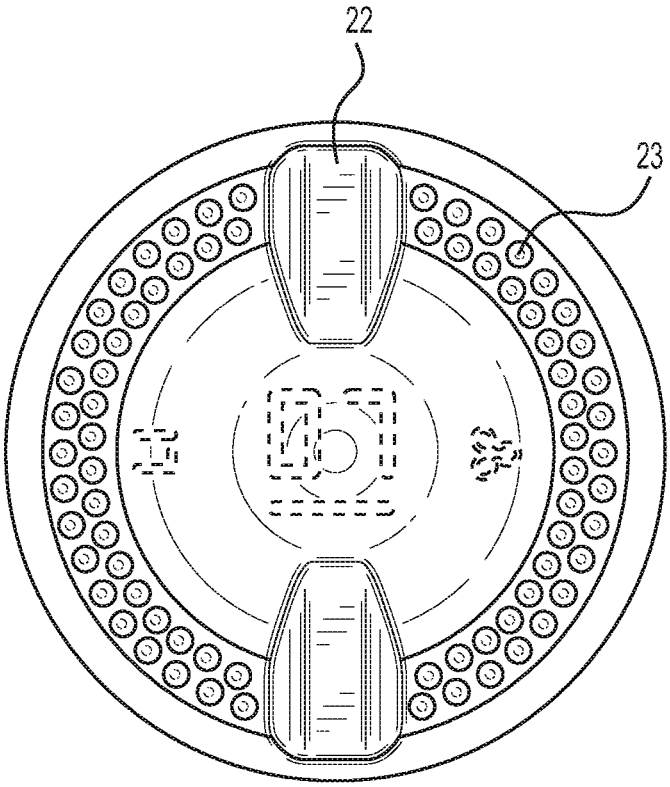
FIG. 13 shows a bottom view of a dispenser package of FIG. 9.
Figure 14:
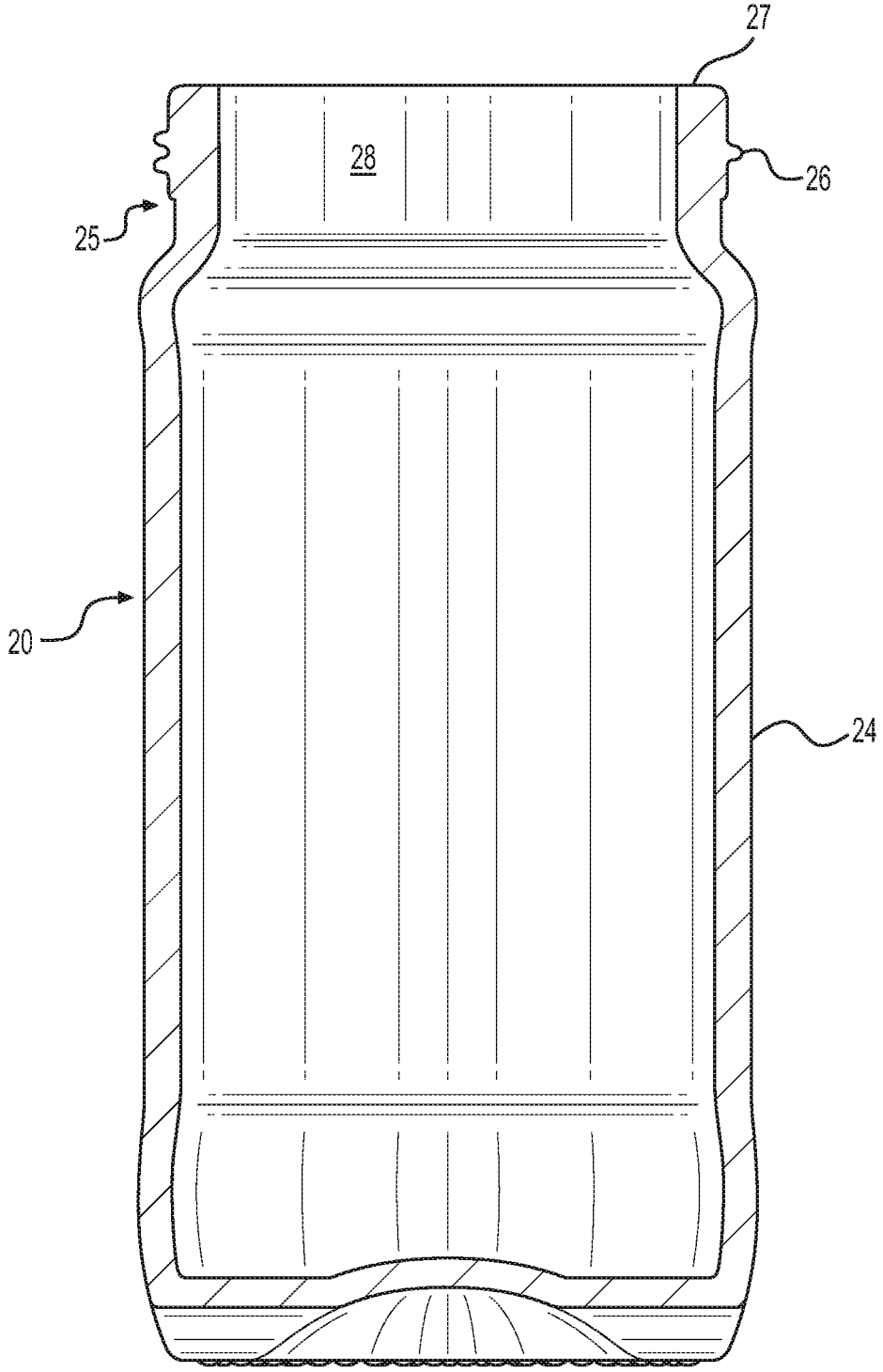
FIG. 14 shows a cross-section view of a dispenser package of FIG. 10.

Referring to FIGS. 2-7, it can be seen that the cap 100 has a front projection or lip 123 that allows a user to grip and lift-up the flip-up lid 118. The flip-up lid 118 is connected at a rear side of a skirt 101 of the cap 100 by living hinge system 119 made up of plural integral hinges 119A, 119B and 119C. The hinge system 119 is such that they function as a spring so that upon lifting up the front of the flip-up lid 118 to a certain extent, they cause the flip-up lid 118 to swing to a predetermined open position similar to that shown in FIG. 30. The skirt 101 forms part of a cap body and has a somewhat tapered outer surface 102 which generally enlarges toward the container. The container bottom 21 can have alignment notches 22 and plural generally 7 circular or rounded projections 23 as shown in FIG. 7. The container 20 can be made of synthetic resin or glass, and can have a generally uniform thickness wall as shown in FIG. 8.

With reference to FIGS. 9-14, it can be seen that the container body 20 can be a one-piece member that somewhat resembles a glass jar and that includes the bottom 21 with one or more notches 22 and projections 23, as discussed above, as well as an indented center portion (also arranged on the bottom 21) and including a generally cylindrical sidewall 24 that extends from a slightly bulbous portion located near the bottom 21 to a neck 25. The neck 25 has a reduced diameter section which includes an external thread 26 and a circular rim 27. The rim 27 defines an opening 28 and this opening 28 can be sized to be large enough to receive a tea spoon so as to allow contents to be spooned out if desired.

Figure 15:
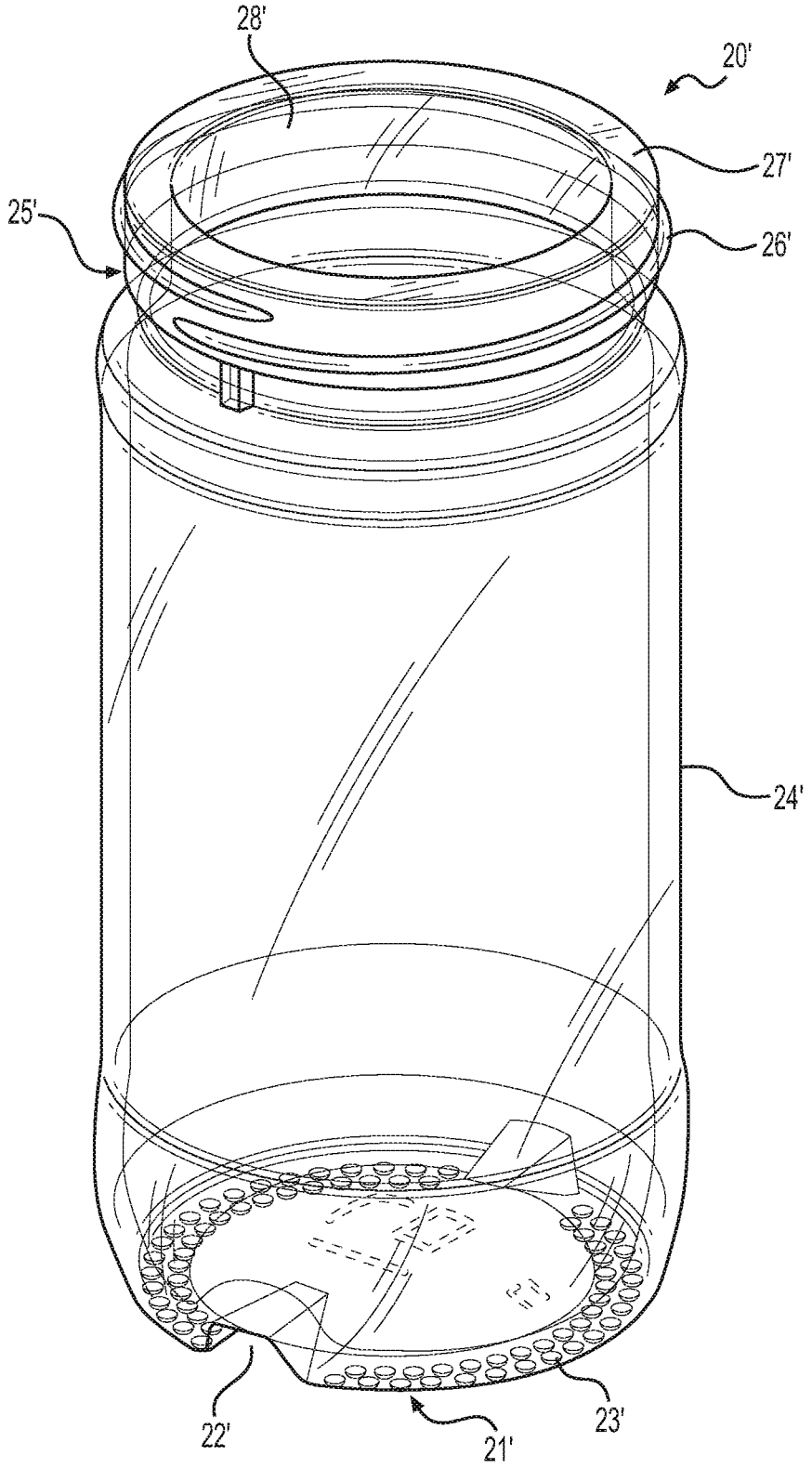
FIG. 15 shows a perspective view of a transparent version of the container body used in the dispenser package of FIG. 1.
Figure 16:
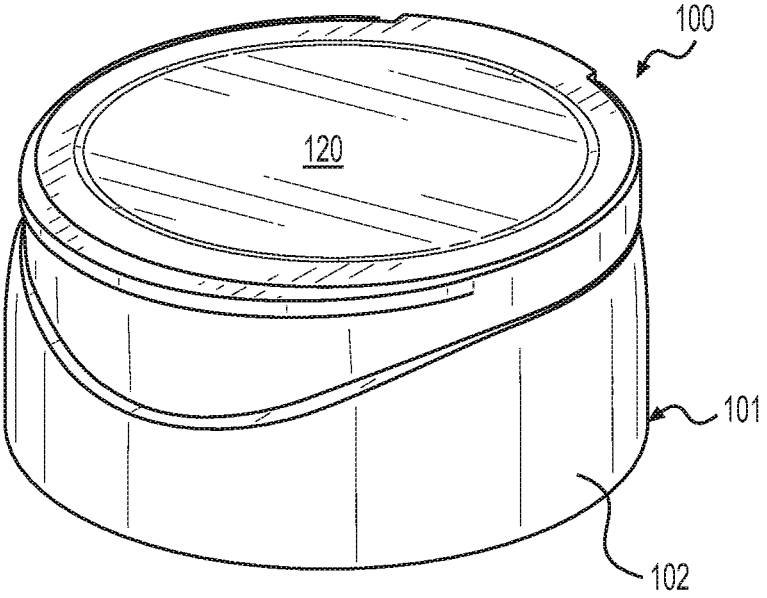
FIG. 16 shows a perspective view of the cap used in the dispenser package of FIG. 1.
Figure 17:
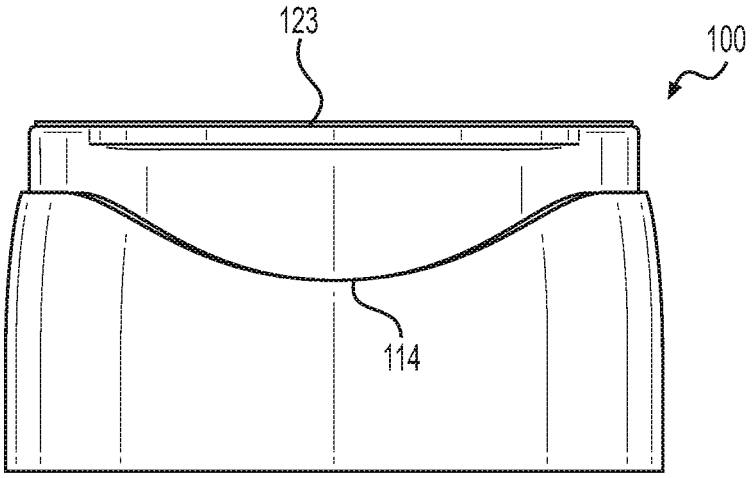
FIG. 17 shows a front view of the cap of FIG. 16.
Figure 18:
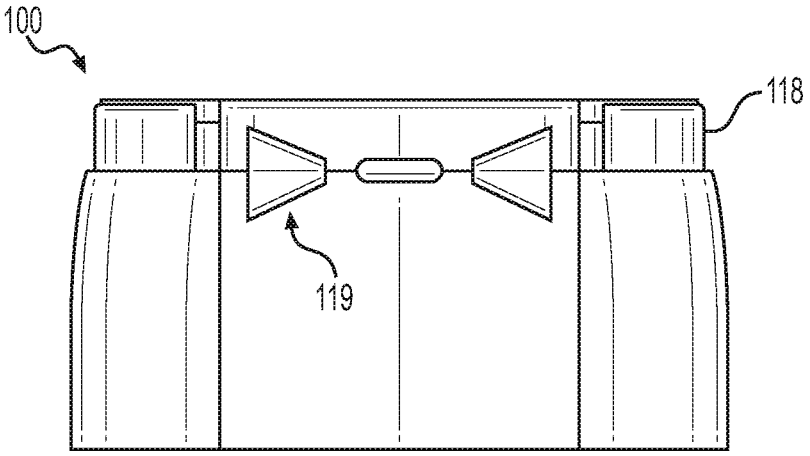
FIG. 18 shows a back view of the cap of FIG. 16.
Figure 19:
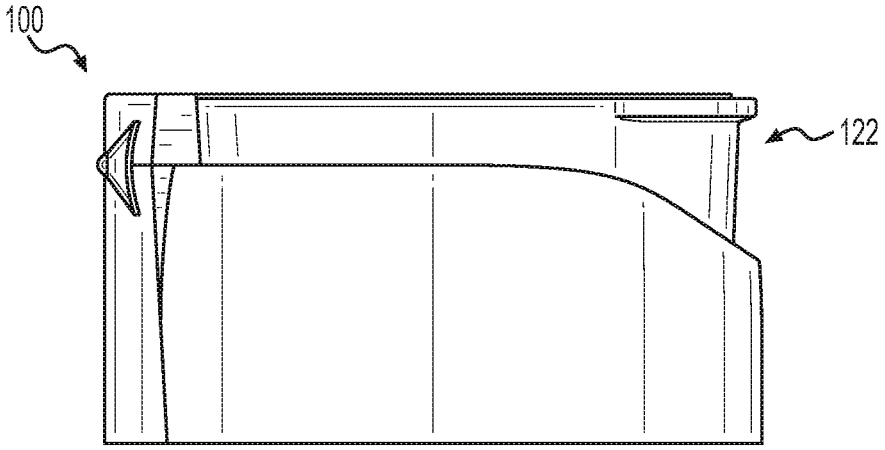
FIG. 19 shows a left view of the cap of FIG. 16.
Figure 20:
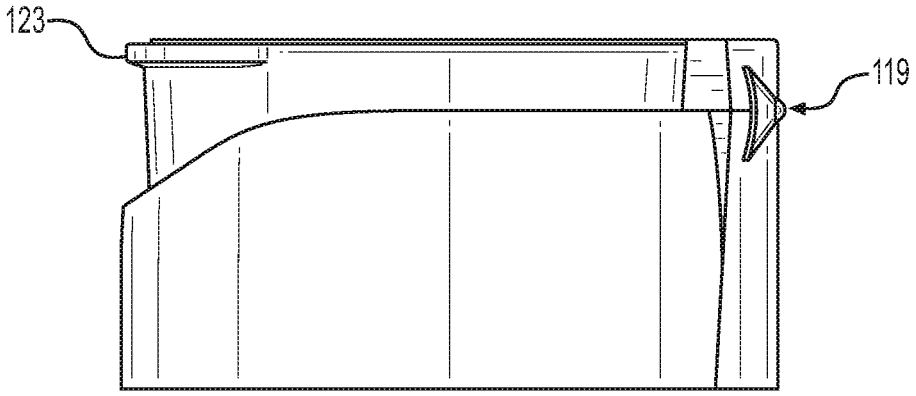
FIG. 20 shows a right view of the cap of FIG. 16.
Figure 21:
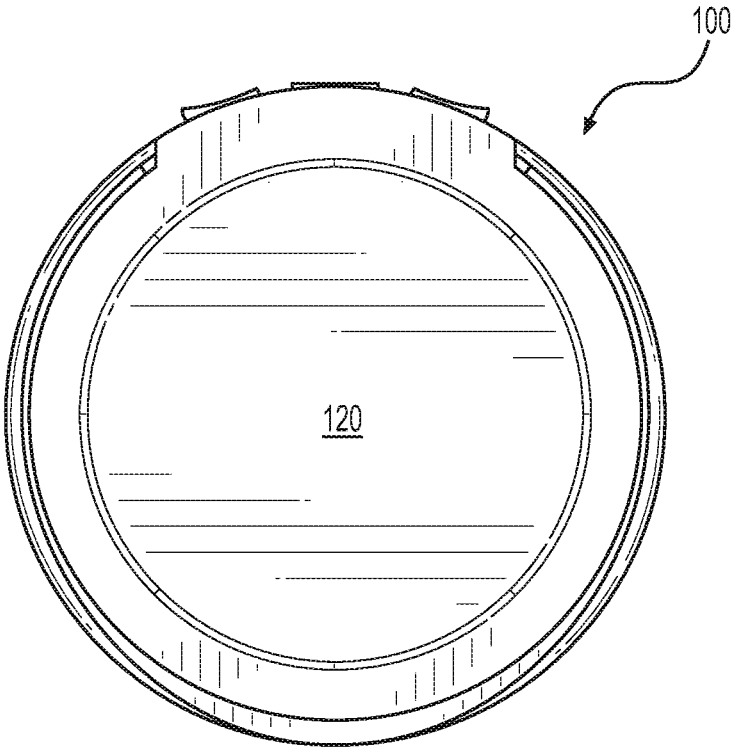
FIG. 21 shows a top view of the cap of FIG. 16.

In FIGS. 1-14, one can see an embodiment where the container 20 is opaque. However, the container 20' can also be translucent or transparent as shown in FIG. 15 so as to allow a user or consumer to view the contents and/or the quantity of the same therein.

Figure 22:
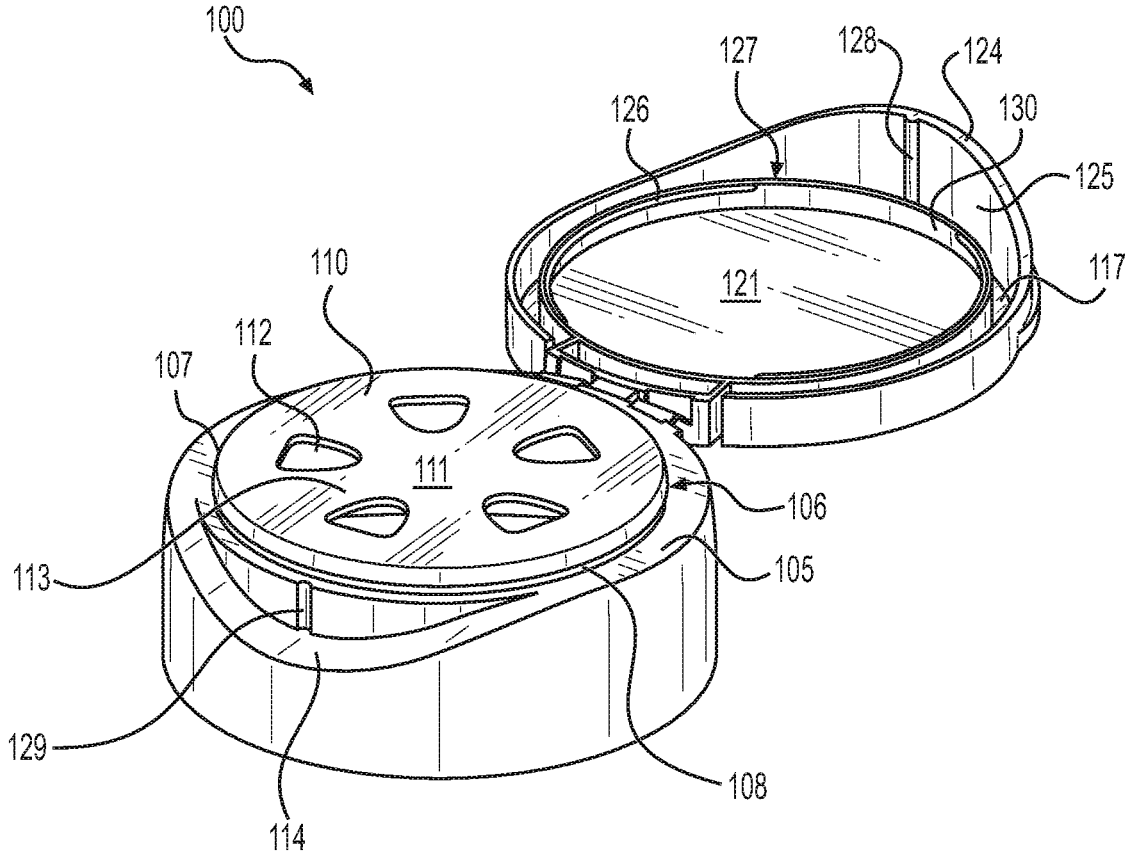
FIG. 22 shows a perspective view of one embodiment of the cap of FIG. 16 in an open position.
Figure 23:
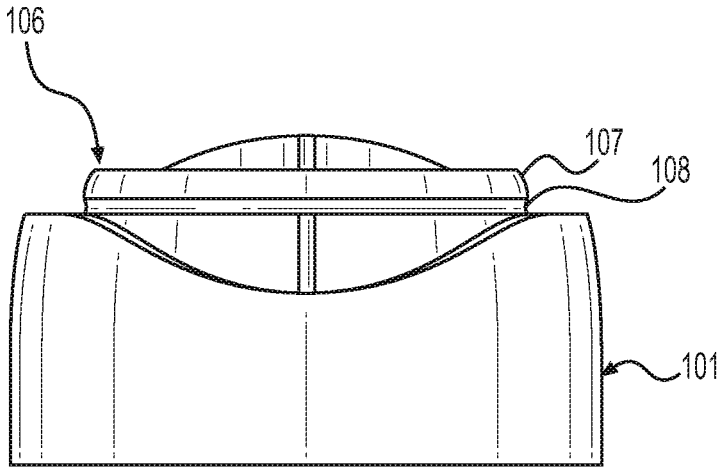
FIG. 23 shows a front view of the cap of FIG. 22.
Figure 24:
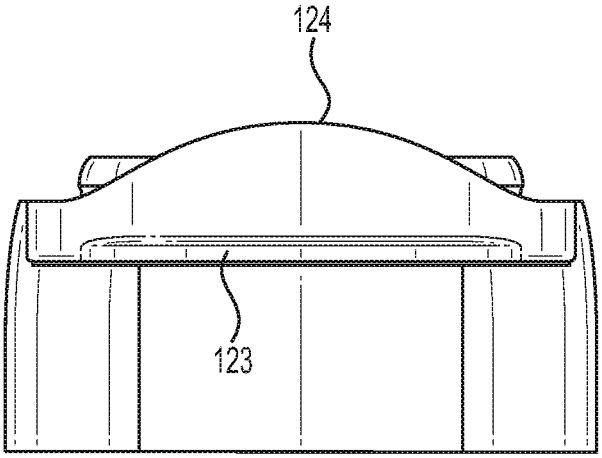
FIG. 24 shows a back view of the cap of FIG. 22.
Figure 25:
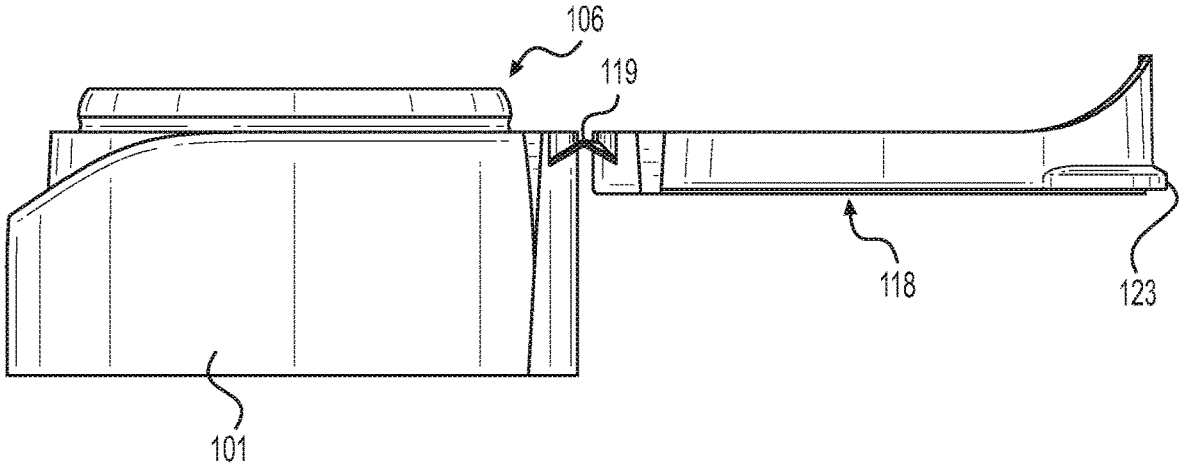
FIG. 25 shows a right view of the cap of FIG. 22.
Figure 26:
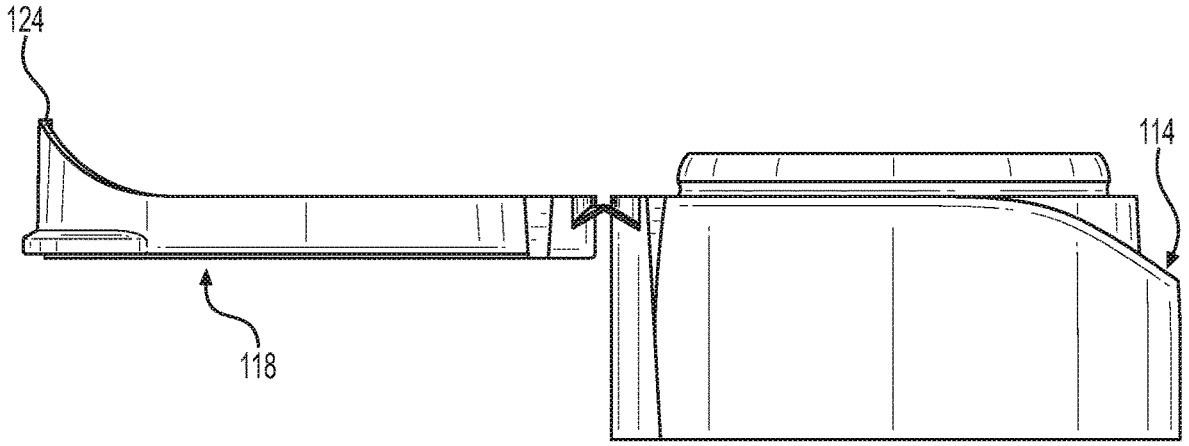
FIG. 26 shows a left view of the cap of FIG. 22.
Figure 27:
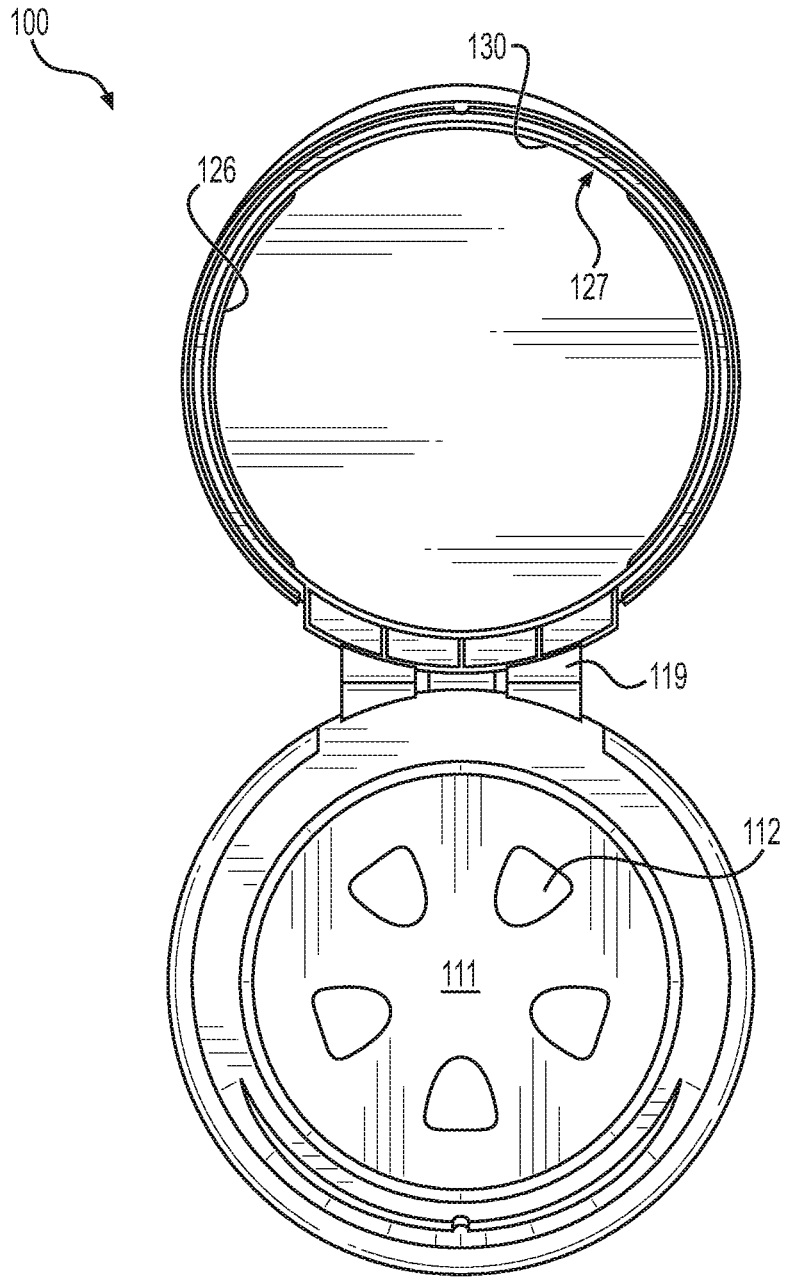
FIG. 27 shows a top view of the cap of FIG. 22.
Figure 28:
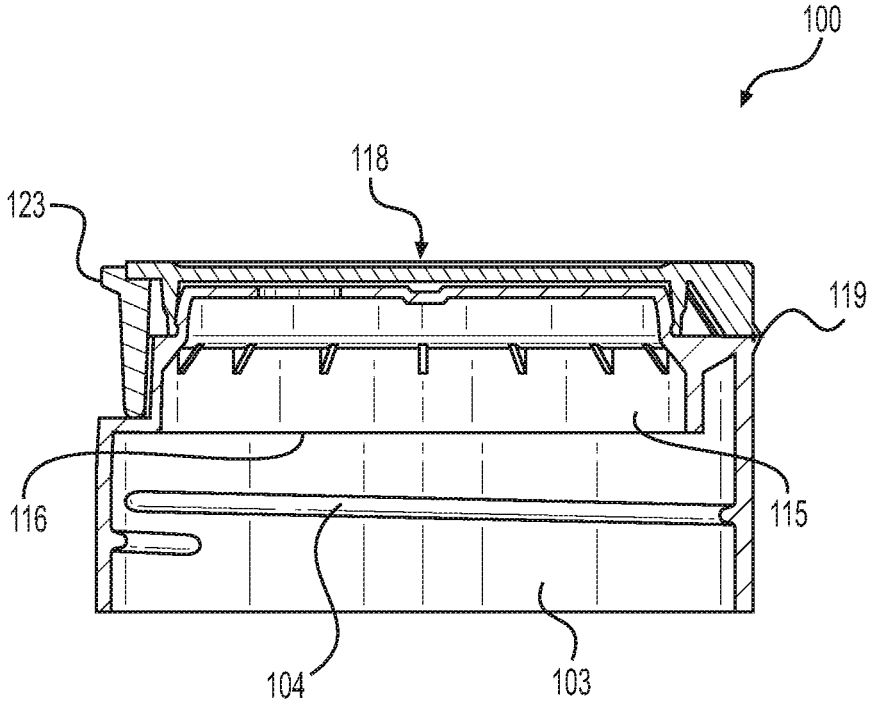
FIG. 28 shows a cross-section view of the cap of FIG. 20.
Figure 29:
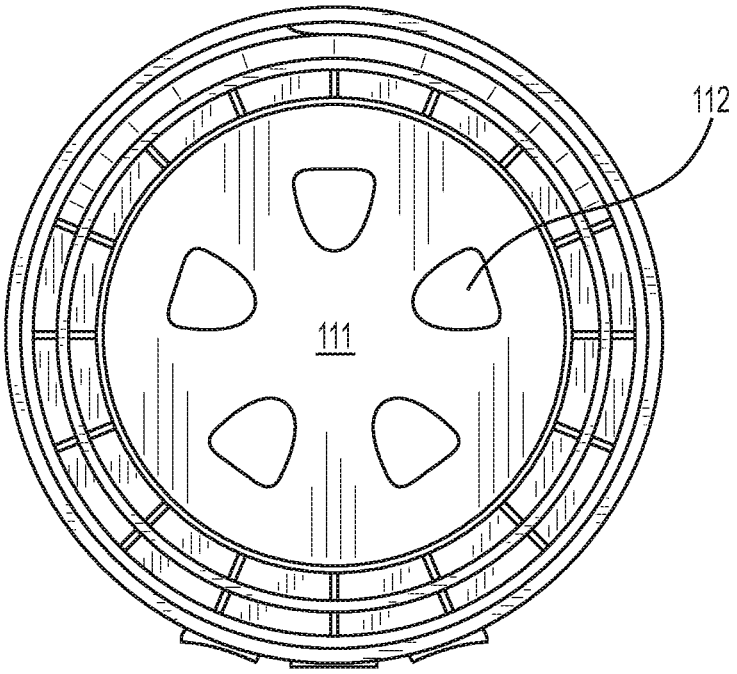
FIG. 29 shows a bottom view of the cap of FIG. 17.

As shown in FIGS. 16-31, the cap 100 can include a skirt 101 having a slightly tapered outer surface 102 and an inner surface 103 having an inner or internal thread 104. The thread 104 is sized and configured to engage with the outer thread 26 of the container 20. As can be seen in FIG. 22, an annular upper end 105 is arranged on the cap 100 and surrounds a projecting portion 106, which includes a curved outer circumferential surface 107 and a circumferential recess 108. A dispensing wall 110 includes a planar surface 111 and dispensing openings 112, which in some embodiments define closed areas or spokes 113. An inwardly curved recess or indentation 114 is located at a front side of the cap 100. The recess 114 can accommodate the outwardly curved front portion of the lid 118 which includes the surfaces 124 and 125. Inside the cap 100, there is located an inner circular flange 115 having a flange rim 116 and an annular space 117 (see FIGS. 22 and 28).

Figure 30:
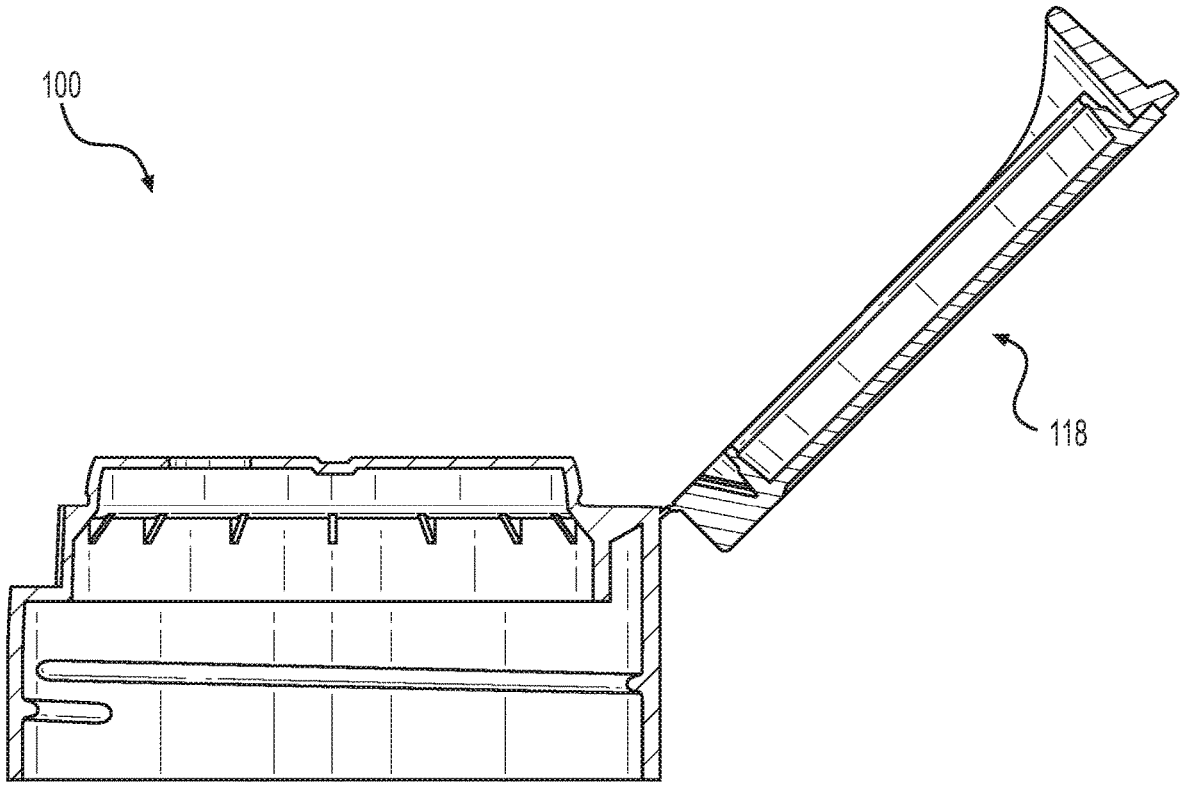
FIG. 30 shows a cross-section view of one embodiment of the cap of FIG. 16 in a partially open position.
Figure 31:
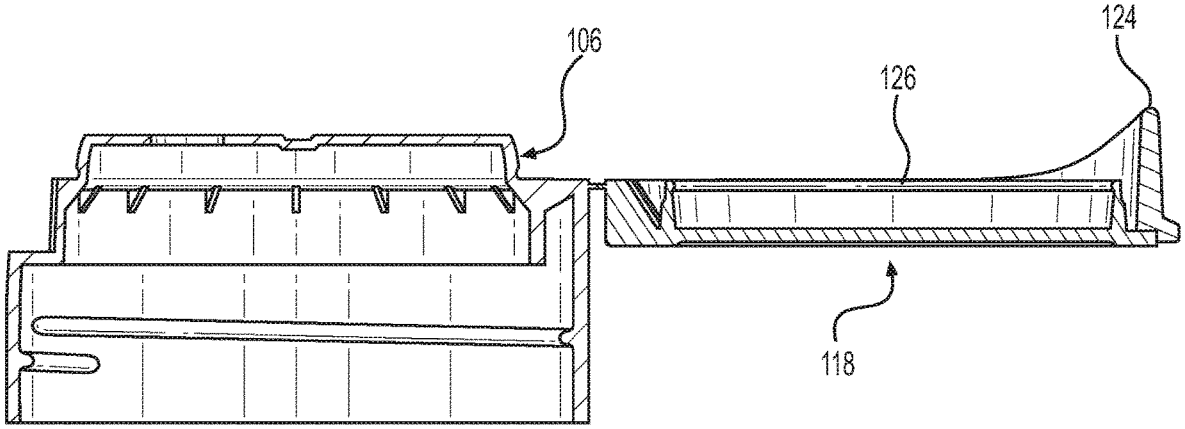
FIG. 31 shows a cross-section view of one embodiment of the cap of FIG. 16 in a fully open position.
Figure 32:
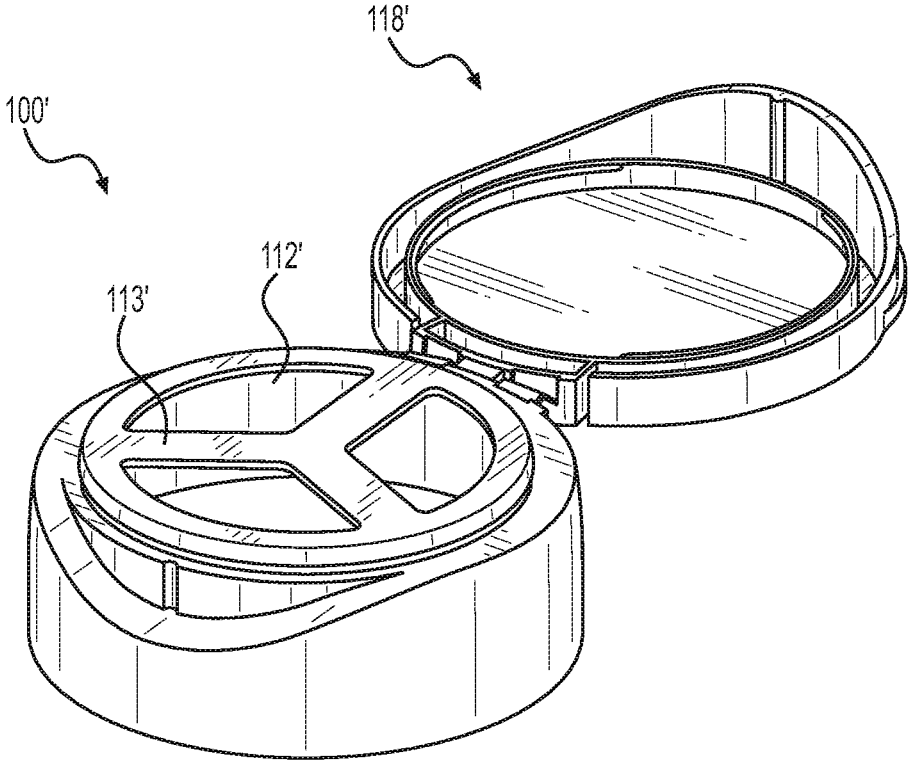
FIG. 32 shows a perspective view of another embodiment of the cap of FIG. 16 in an open position.
Figure 33:
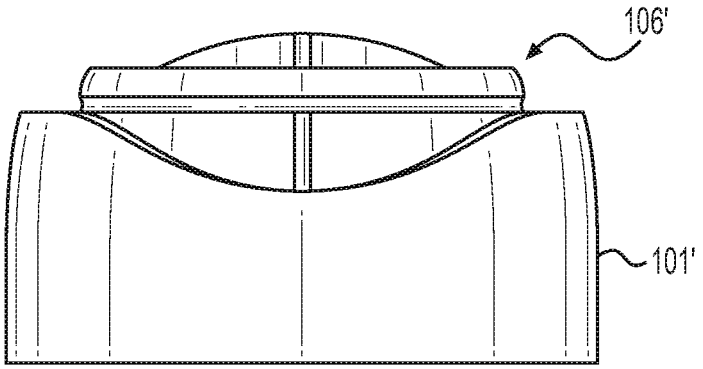
FIG. 33 shows a front view of the cap of FIG. 32.
Figure 34:
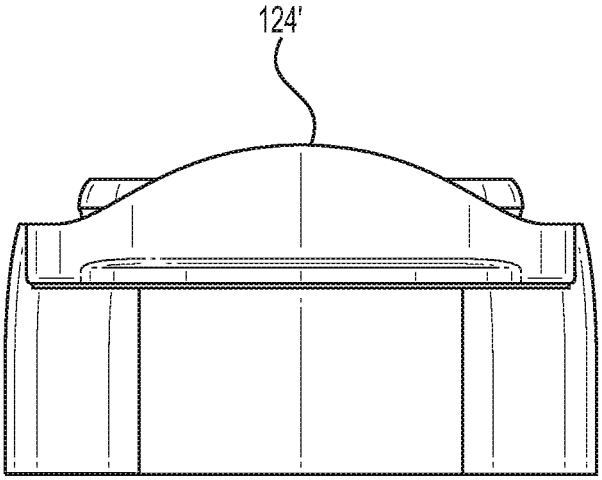
FIG. 34 shows a back view of the cap of FIG. 32.
Figure 35:
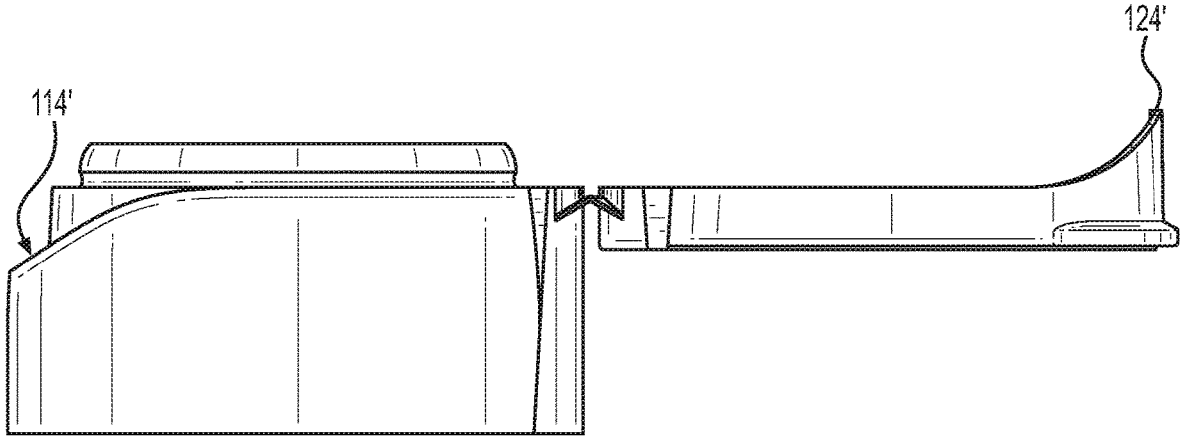
FIG. 35 shows a right view of the cap of FIG. 32.
Figure 36:
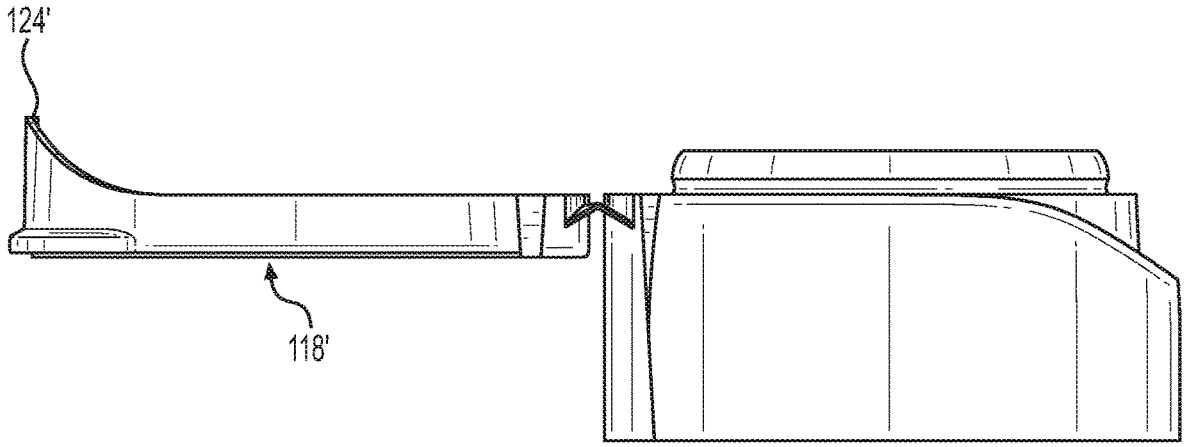
FIG. 36 shows a left view of the cap of FIG. 32.
Figure 37:
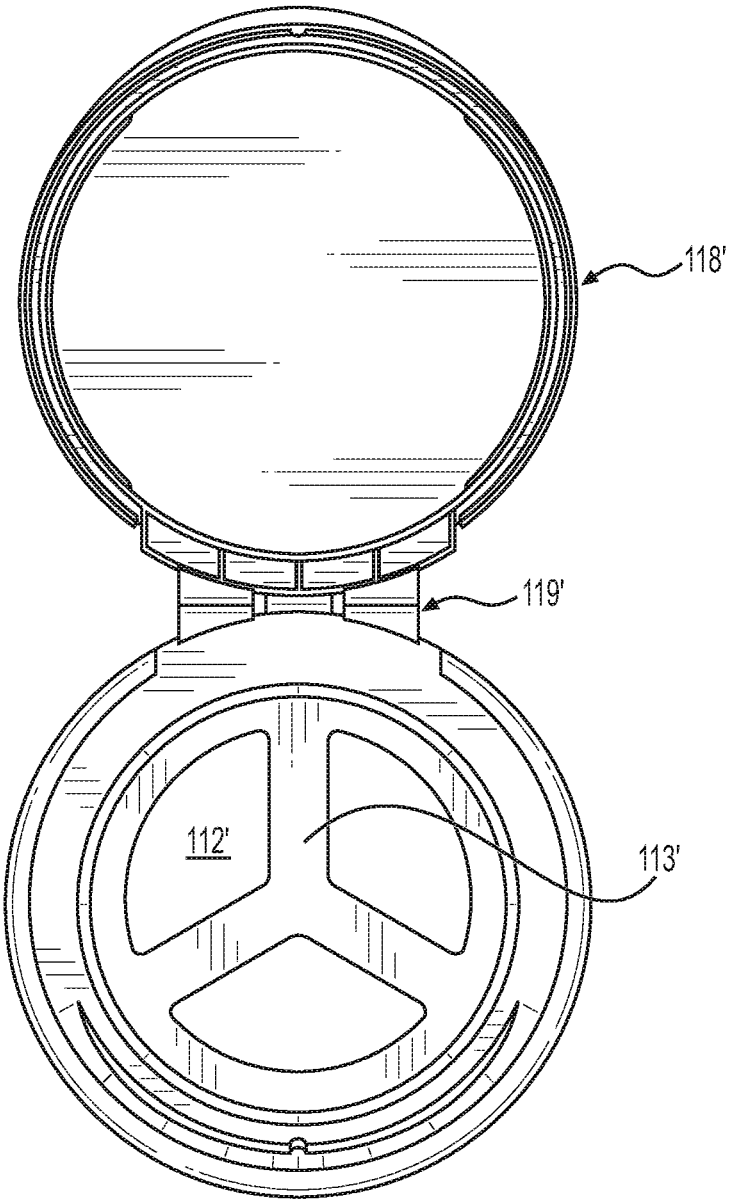
FIG. 37 shows a top view of the cap of FIG. 32.
Figure 38:
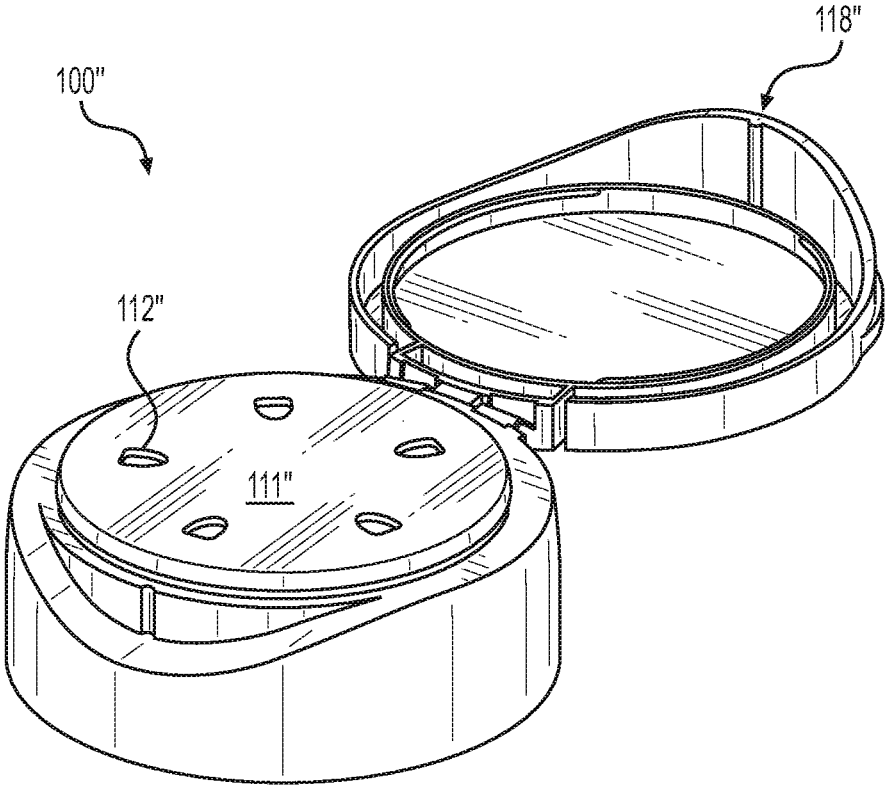
FIG. 38 shows a perspective view of another embodiment of the cap of FIG. 16 in an open position.
Figure 39:
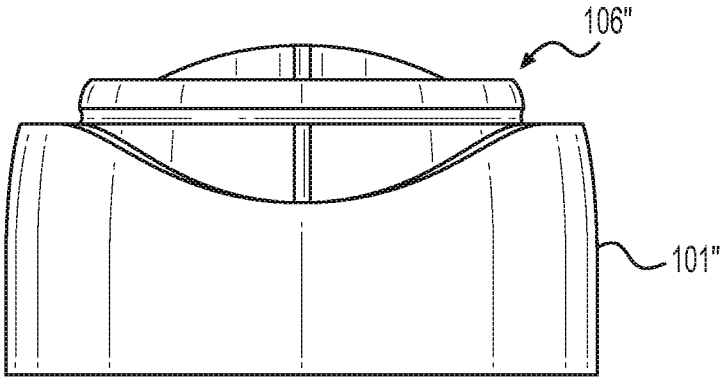
FIG. 39 shows a front view of the cap of FIG. 38.
Figure 40:
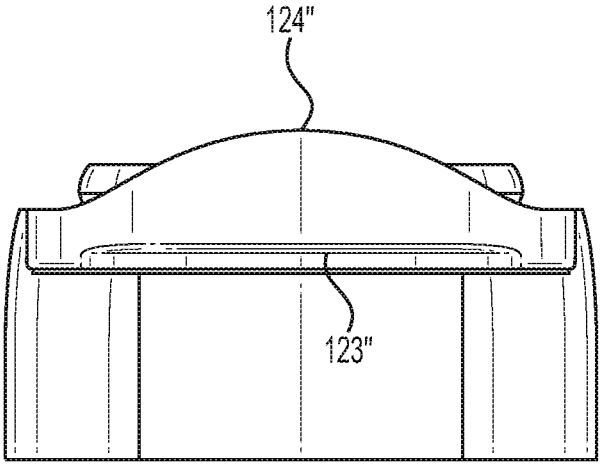
FIG. 40 shows a back view of the cap of FIG. 38.
Figure 41:
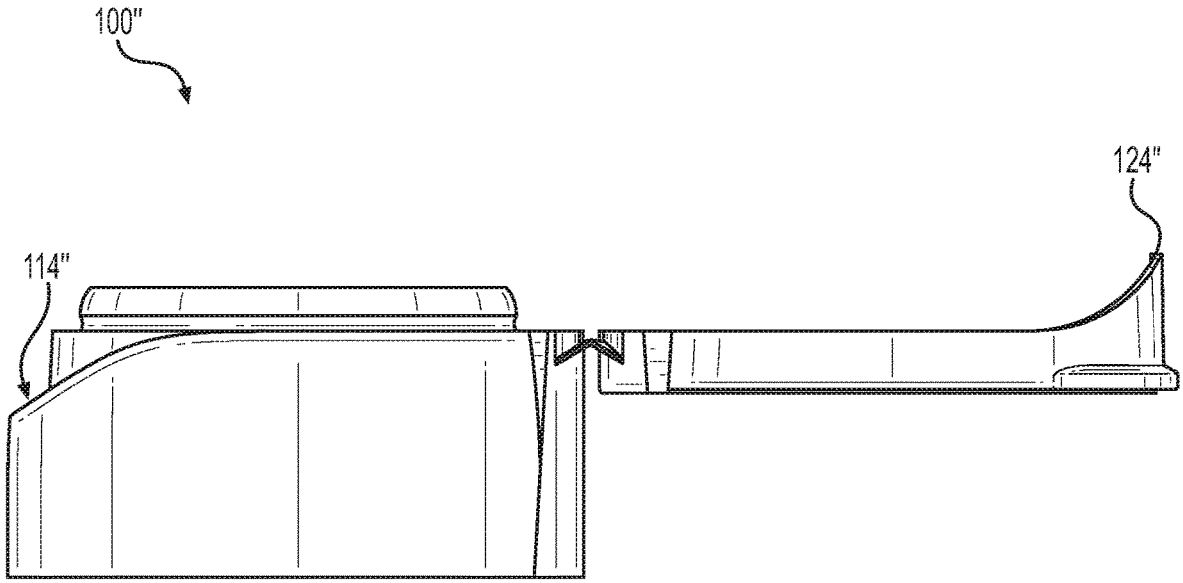
FIG. 41 shows a right view of the cap of FIG. 38.
Figure 42:
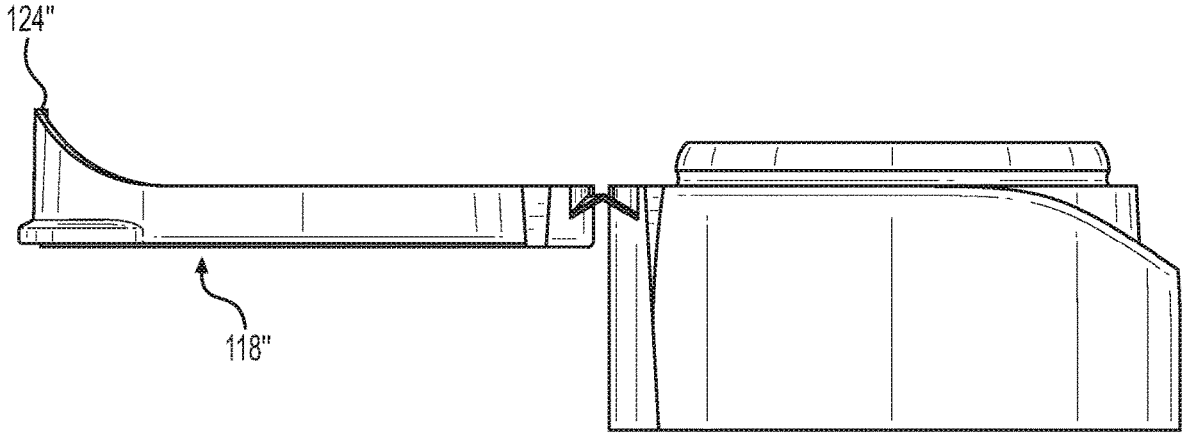
FIG. 42 shows a left view of the cap of FIG. 38.
Figure 43:
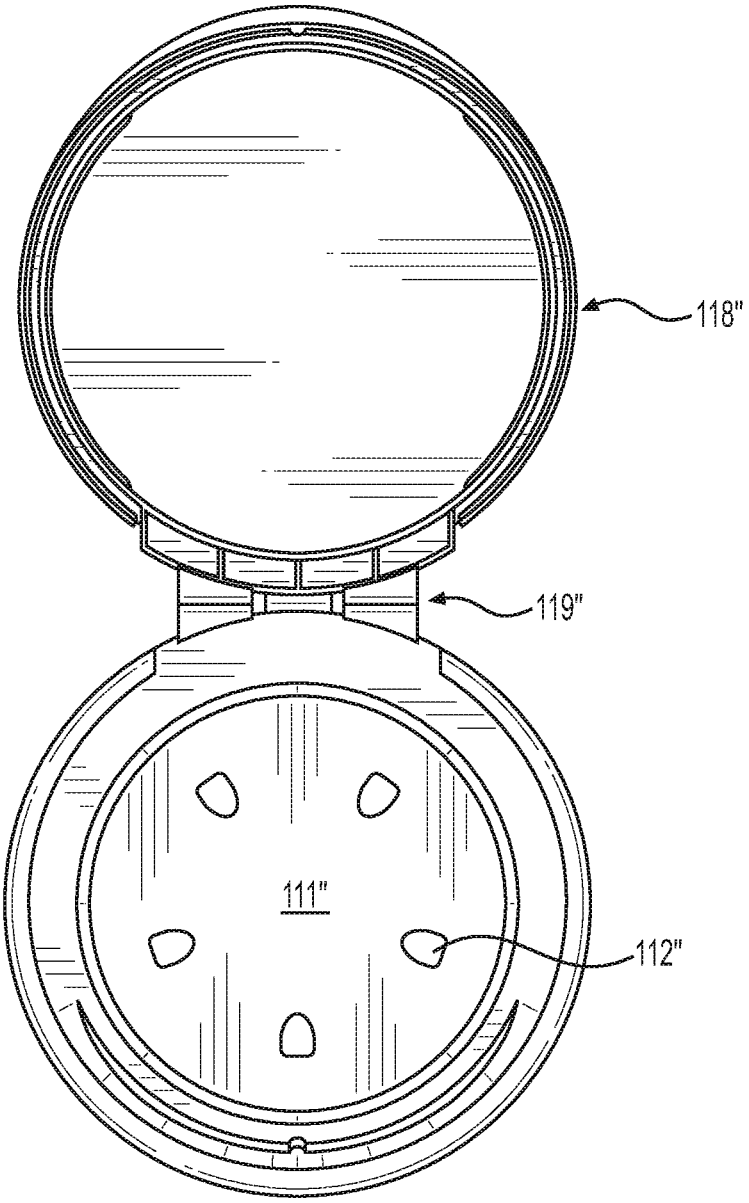
FIG. 43 shows a top view of the cap of FIG. 38.

As noted above and evident from FIG. 16-31, the cap 100 includes a flip-up lid or cover 118 that can be moved to at least an open and a closed position. The lid 118 is connected to skirt 101 via a living hinge system 119 which can be formed by hinge parts 119A, 119B and 119C. The lid 118 has a planar upper surface 120 and a planar inner surface 121. A finger engaging portion 122 can be made of different material, e.g. softer, less rigid, and/or more flexible than a main part of the lid, and can be over-molded onto the lid 118. A lift-up projection 123 is located on a front side of the portion 122 and a lower curved projection 124 is located on a lower front side thereof. An inner circumferential surface 130 includes one or more circumferential retaining projections 126 and these are arranged on a circular retaining flange 127. The projections 126 are configured to engage with the recess 108 when the lid 118 is in a closed position and functions to retain the closed position. This projection/recess engagement is released or disengages when the user exerts pressure on the projection 123 to move the lid 118 to the open position. The circumferential surfaces having the projections 126 and recess 108 can function to provide a sealing engagement between the lid 118 and cap body. The cap 100 also includes a guide projection 128 that engages with a guide recess 129. To facilitate proper opening or closing of the lid 118, a guide projection 128 can engage with a guide recess 129. This is further facilitated by the rounded or tapered shape of the surface 107 In the closed position of the lid 118, the surface 124 will be positioned close to or abut the comparably shaped recess 114. As is apparent from FIGS. 30 and 31, the lid 118 can be opened to a predetermined position as shown in FIG. 30 and be retained therein by action of the hinge system 119, or it can be moved to a more fully open position shown in FIG. 31 by action of the consumer or user.

FIGS. 32-37 show another exemplary cap 100'. Unlike the previous cap which employed a larger number of smaller openings in the dispensing wall, this embodiment employs a smaller number of larger dispensing openings 112' located between spokes 113'. The cap 100' can otherwise include all of the same features as the previous embodiment such as the living hinge system 119' and flip-up lid 118'. The size of the openings 112' can be tailored to the product being dispensed so that, for example, with a product such as ground pepper, the openings 112' shown in FIG. 32 can allow for this substance to be poured out. On the other hand, with the smaller openings of the previous embodiment, the same ground pepper can be sprinkled out during the product dispensing. Like the previous embodiment, the cap 100' can be used with either container 20 or 20' described above.

FIGS. 38-43 show another exemplary cap 100". Unlike the previous caps which employed either a larger number of smaller openings in the dispensing wall or vice versa, this embodiment employs smaller size dispensing openings 112". The cap 100" can otherwise include all of the same features as the previous embodiment such as the living hinge system 119" and flip-up lid 118". As with the previous embodiments, the size of the openings 112" can be tailored to the product being dispensed so that, for example, with a product such as salt, the openings 112" shown in FIG. 38 can allow for this substance to be sifted out. Like the previous embodiment, the cap 100" can be used with either container 20 or 20' described above.

Example A

A fully or nearly-fully recyclable spice or seasoning dispenser package 1 comprises a generally cylindrical transparent container body 20 made of mostly recycled glass and having an open upper end 27/28 of sufficient size to permit passage there-through of a tea spoon. A recyclable synthetic resin cap 100 is removably mounted to the container body 20. The cap 100 comprises a generally cylindrical cap body securable to an upper end of the container body 20. The cap body comprises a generally circular projecting portion 106 having an outer circumferential surface 107 and an upper surface 110 that includes plural dispensing openings 112. These can be openings 112, 112' or 112" as well as any combination thereof. A flip-up lid 118 is connected to the cap body by a living hinge 119 (119A, 119B and 119C) and is movable between a covering or closed position and an open position. A finger engagable portion 122 at least partially surrounds an upper portion of the flip-up lid 118. The finger engagable portion 122 is made of a softer, less-rigid and/or more flexible material than a main portion of the flip-up lid 118. The flip-up lid 118 comprises an inner circumferential surface 130 that is engagable with the outer circumferential surface 107 of the projecting portion 106. The living hinge 119 is configured to retain the flip-up lid 118 in a predetermined angular open position. The engagement between the inner circumferential surface 130 and the outer circumferential surface 107 is at least one of a snap-engagement produces an audible sound when the flip-up lid 118 is opened and/or closed and a sealing engagement which prevents an exchange of air between an interior of the dispenser package 1 and an atmosphere outside the dispenser package 1. The flip-up lid 118 comprises an upper planar outer surface 120 configured to receive product identification indicia. An inside diameter of the open upper end 28 is about 1.25 inches.

Example B

A synthetic resin dispenser package cap 100 is configured to be mounted to a spice or seasoning container 20. The cap 100 comprises a generally cylindrical cap body securable to an upper end of the container body 20. The cap body comprises a generally circular projecting portion 106 having an outer circumferential surface 107 and an upper surface 110 that includes plural dispensing openings 112, an outer skirt 101 and a generally circular projecting flange 115 having a shorter axial length than the outer skirt 101. The openings can be openings 112, 112' or 112" as well as any combination thereof. The flange 115 is located inside the outer skirt 101 and has a circular rim 116 configured to contact a rim 27 of a container body 20 receiving said cap 100. A generally circular flip-up lid 118 is connected to the cap body by a living hinge 119 and is movable between a covering or closed position and an open position. The flip-up lid 118 comprising an inner circumferential surface 130 that is engagable with the outer circumferential surface 107 of the projecting portion 106. A finger engagable portion 122 at least partially surrounds an upper portion of the flip-up lid 118. The finger engagable portion 122 is made of a softer, less-rigid and/or more flexible material than a main portion of the flip-up lid 118. The engagement between the inner circumferential surface 130 and the outer circumferential surface 107 is at least one of a snap-engagement produces an audible sound when the flip-up lid 118 is opened and closed. A sealing engagement which prevents an exchange of air between an interior of the dispenser package 1 and an atmosphere outside the dispenser package 1 when the cap is in an installed state.

Example C

A spice dispenser package container body 20' has a volume of about 3 ounces and is made of mostly recyclable glass. The container body 20' comprises a generally continuously cylindrical transparent sidewall 24', a closed bottom 21' having an external notch 22' and semi-rounded projections 23'. A reduced diameter upper end 24' extends to a circular rim 27'. An external thread 26' is arranged on the reduced diameter upper end 25'. A removable seal 10 may close off the open upper end 27'/28'.

Further, at least because the invention is disclosed herein in a manner that enables one to make and use it, by virtue of the disclosure of particular exemplary embodiments, such as for simplicity or efficiency, for example, the invention can be practiced in the absence of any additional element or additional structure that is not specifically disclosed herein.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

Dispenser Package 1
Removable Seal 10
Container body 20
Bottom 21
Notch 22
Projections 23
Sidewall 24
Neck 25
External thread 26
Rim 27
Opening 28
Cap 100
Skirt 101
Tapered outer surface 102
Inner surface 103
Inner thread 104
Annular upper end 105
Projecting Portion 106
Curved outer Cir. surface 107
Circumferential recess 108
Dispensing part 110
Planar surface 111
Dispensing openings 112
Spokes 113
Inwardly curved recess 114
Inner circular flange 115
Flange rim 116
Annular space 117
Flip-up lid 118
Living hinge 119
Hinge part 119A
Hinge part 119B
Hinge part 119C
Planar upper surface 120
Planar inner surface 121
Finger engaging portion 122
Lift-up projection 123
Lower curved projection 124
Inner circum. surface 125
Circum. retaining projection 126
Circular retaining flange 127
Guide projection 128
Guide recess 129
Inner cylindrical surface 130

The above reference numbers can have similar numbers identified with a prime and double prime indicator to identify other embodiments. For example, ref. 20 can be 20' or 20".

What is claimed is:

1. A dispenser package comprising:

a generally cylindrical container body;

a cap removably mounted to the container body and comprising:

a generally cylindrical cap body securable to an upper end of the container body;

said cap body comprising:

a generally circular projecting portion having an outer circumferential surface and an upper surface that includes plural dispensing openings; and an inwardly curved recess located at a lower front side of the cap body and includes a guide recess, the inwardly curved recess being positioned below and radially outward of the projecting portion; and a generally circular flip-up lid connected to the cap body by a living hinge and being movable between a covering position and an open position, said flip-up lid comprising:

a lower curved projection located on a lower front side of the flip up lid that can be accommodated in the inwardly curved recess, the lower curved projection including a guide projection provided on an inner circumferential surface, the guide projection being engageable with the guide recess; and a circular retaining flange provided inside the flip up lid and radially separated from the lower curved projection by an annular space, the circular retaining flange being engagable with the outer circumferential surface of the projecting portion, wherein an engagement between the circular retaining flange and the outer circumferential surface of the projecting portion, and an engagement between the guide projection and the guide recess define:

a snap-engagement which produces an audible sound when the flip-up lid is opened and/or closed; and a sealing engagement which prevents an exchange of air between an interior of the dispenser package and an atmosphere outside the dispenser package.

2. The dispenser package of claim 1, wherein the dispenser package has an outer diameter of between 1 and 2 inches and an overall axial length of between 3.5 and 4.5 inches.

3. The dispenser package of claim 2, wherein the outer diameter is between 1.5 and 1.75 inches.

4. The dispenser package of claim 2, wherein the overall axial length is between 3.75 and 4.25 inches.

5. The dispenser package of claim 1, wherein the container body is one of:

substantially transparent; and substantially translucent.

6. The dispenser package of claim 1, wherein the container body is made of one of:

a recyclable material; and glass.

7. The dispenser package of claim 1, wherein the cap is made of one of:

a recyclable material; and synthetic resin.

8. The dispenser package of claim 1, wherein the living hinge is configured to retain the flip-up lid in a predetermined angular open position.

9. The dispenser package of claim 8, wherein the predetermined angular open position is an angle between 20 degrees and 45 degrees relative to a vertical center axis of the container body.

10. The dispenser package of claim 8, wherein the predetermined angular open position is an angle of about 30 degrees relative to a vertical center axis of the container body.

11. The dispenser package of claim 1, wherein a diameter of the outer circumferential surface is about 1.25 inches.

12. The dispenser package of claim 1, wherein the outer circumferential surface is outwardly curved or tapered in an axial direction.

13. The dispenser package of claim 1, wherein the outer circumferential surface comprises a circumferential indentation or recess.

14. The dispenser package of claim 1, wherein the inner circumferential surface comprises a projection.

15. The dispenser package of claim 14, wherein the projection is disposed on a lower end of the inner circumferential surface when the flip-up lid is in a closed position and the container body is in an upright position.

16. The dispenser package of claim 1, wherein the dispenser package contains a spice.

17. The dispenser package of claim 16, wherein the spice is food granules, plant seeds or plant leaves such as oregano.

18. The dispenser package of claim 1, wherein the container body comprises:

a generally cylindrical transparent sidewall;

a closed bottom having an external notch and semi-rounded projections;

an open upper end extending to a circular rim;

a removable seal having a lower side whose perimeter area is removably secured to a rim of the open upper end; and an external thread arranged on the open upper end to which the cap is removably mounted.

19. A synthetic resin dispenser package cap configured to be mounted to a spice or seasoning container, comprising:

a generally cylindrical cap body securable to an upper end of the container body;

said cap body comprising:

a generally circular projecting portion having an outer circumferential surface and an upper surface that includes plural dispensing openings; and an inwardly curved recess located at a lower front side of the cap body and includes a guide recess, the inwardly curved recess being positioned below and radially outward of the projecting portion; and a generally circular flip-up lid connected to the cap body by a living hinge and being movable between a covering position and an open position, said flip-up lid comprising:

a lower curved projection located on a lower front side of the flip up lid that can be accommodated in the inwardly curved recess, the lower curved projection including a guide projection provided on an inner circumferential surface, the guide projection being engageable with the guide recess; and a circular retaining flange provided inside the flip up lid and radially separated from the lower curved projection by an annular space, the circular retaining flange being engagable with the outer circumferential surface of the projecting portion, wherein an engagement between the circular retaining flange and the outer circumferential surface of the projecting portion, and an engagement between the guide projection and the guide recess define:

a snap-engagement which produces an audible sound when the flip-up lid is opened and closed; and a sealing engagement which prevents an exchange of air between an interior of the dispenser package and an atmosphere outside the dispenser package.

20. A method of making the dispenser package of claim 1, the method comprising:

placing a food product inside the container body; and mounting the cap to the container body.

* * * * *